US011058269B2

(12) United States Patent
Zhang et al.

(10) Patent No.: US 11,058,269 B2
(45) Date of Patent: Jul. 13, 2021

(54) VACUUM CLEANER

(71) Applicant: MAKITA CORPORATION, Aichi (JP)

(72) Inventors: Zhixing Zhang, Kunshan (CN); Haowei Mei, Kunshan (CN); Jin Hong, Kunshan (CN)

(73) Assignee: MAKITA CORPORATION, Anjo (JP)

( * ) Notice: Subject to any disclaimer, the term of this patent is extended or adjusted under 35 U.S.C. 154(b) by 620 days.

(21) Appl. No.: 15/891,056

(22) Filed: Feb. 7, 2018

(65) Prior Publication Data

US 2018/0220861 A1 Aug. 9, 2018

(30) Foreign Application Priority Data

Feb. 8, 2017 (CN) ..... 201710068623.6

(51) Int. Cl.
*A47L 9/00* (2006.01)
*A47L 9/28* (2006.01)
(Continued)

(52) U.S. Cl.
CPC ..... *A47L 9/0081* (2013.01); *A47L 5/24* (2013.01); *A47L 7/0023* (2013.01);
(Continued)

(58) Field of Classification Search
CPC ..... A47L 5/24; A47L 9/2884; A47L 9/0081; A47L 9/0027; A47L 9/0036;
(Continued)

(56) References Cited

U.S. PATENT DOCUMENTS 6,367,118 B1 4/2002 Berfield
2013/0086770 A1* 4/2013 Wolfe, Jr. ..... A47L 9/2884 15/412
2014/0215750 A1* 8/2014 Schultz ..... A47L 9/26 15/323

FOREIGN PATENT DOCUMENTS

CN 2322532 Y 6/1999
CN 2922757 Y 7/2007
(Continued)

OTHER PUBLICATIONS

Mar. 9, 2021 Office Action issued in Chinese Patent Application No. 201710068623.6.

*Primary Examiner* — Andrew A Horton
(74) *Attorney, Agent, or Firm* — Oliff PLC

(57) ABSTRACT

A vacuum cleaner, which is a portable vacuum cleaner, including a tank body, a head portion disposed above the tank body, and a battery connection portion that is disposed at the head portion and is capable of connecting to a battery. A part of an upper end portion of the tank body has a bent shape or a curved shape, and the rest part of the upper end portion of the tank body has a shape neither bending inward nor curved inward. The vacuum cleaner may further include a battery connection portion disposed at the head portion and a brushless motor disposed at the head portion. The vacuum cleaner is easy to assemble, portable, convenient in checking the battery level, waterproof and has a good performance of drainage, high efficiency in dust vacuuming, small size and compact structure, light weight, and improved service period.

6 Claims, 20 Drawing Sheets

(51) Int. Cl.
*A47L 5/24* (2006.01)
*A47L 7/00* (2006.01)
*A47L 9/14* (2006.01)

(52) U.S. Cl.
CPC ..... *A47L 7/0028* (2013.01); *A47L 7/0095* (2013.01); *A47L 9/0027* (2013.01); *A47L 9/0036* (2013.01); *A47L 9/0063* (2013.01); *A47L 9/2884* (2013.01); *A47L 9/14* (2013.01)

(58) Field of Classification Search
CPC ..... A47L 9/0063; A47L 9/14; A47L 7/0023; A47L 7/0028; A47L 7/0095
See application file for complete search history.

(56) References Cited

FOREIGN PATENT DOCUMENTS

| | | | |
|---|---|---|---|
| CN | 201542559 | U | 8/2010 |
| CN | 204708769 | U | 10/2015 |
| EP | 0728435 | A1 | 8/1996 |

* cited by examiner

VACUUM CLEANER

CROSS-REFERENCE TO RELATED APPLICATION

The present application is based upon and claims the benefit of a priority of Chinese Patent Application No. 201710068623.6, filed on Feb. 8, 2017, the entire contents of which are incorporated herein by reference.

TECHNICAL FIELD

The present disclosure relates to a vacuum cleaner. In particular, the present disclosure relates to a portable vacuum cleaner capable of arranging and using a battery for a power tool.

BACKGROUND

Patent document 1 discloses a vacuum cleaner comprising a motor, a fan, an intake port, a gas passage and an exhaust port.

PRIOR ART LITERATURE

Patent document 1: EP0728435

SUMMARY

Problems to be Solved

In conventional vacuum cleaners, the intake port and the exhaust port are not significantly distinguished in appearance. Therefore, if the operator is not familiar with the structure of the vacuum cleaner, or when the operator is in a hurry, the intake port and the exhaust port may be mistaken, causing that a suction hose is attached to the exhaust port. Thus, when the suction hose is assembled to the vacuum cleaner, the user needs to take time to confirm the intake port, causing inconvenience.

In addition, there is no specific study in the arrangement of the intake port and the exhaust port up to now. Thus, the user may be affected by the air blown out from the exhaust port and thus feels uncomfortable. Moreover, the air flow from the exhaust port may affect the region to be cleaned by the vacuum cleaner, causing the dust to scatter around the operator and thereby affecting the cleaning operation of the operator.

Further, a vacuum cleaner is usually used together with power tools such as hammer drills, jig saws and screw drivers, etc. Therefore, the operator has to carry both the vacuum cleaner and the power tool or a tool box containing these power tools, which is very inconvenient.

Moreover, in general, a vacuum cleaner can use a battery used for these power tools. But there may be the following problems: the battery is designed such that it is easy to check the remaining electricity quantity when the battery is mounted to a power tool; when it is mounted to the vacuum cleaner, the battery level display is disposed in a narrow space between the battery and the case, which makes it difficult to check the remaining electricity quantity.

Furthermore, as a wet/dry vacuum cleaner, the product may be used in a water environment. Therefore, there is a further need to prevent the battery from getting in contact with water.

In addition, in view of the cost, a tank body of a conventional vacuum cleaner is usually fabricated using a blow molding method and the like. Thus, in order to facilitate the fabrication and to ensure an improved strength of the tank body, there is usually provided on a periphery at the opening side of the tank body a flange extending toward the interior. As a result, it is difficult to thoroughly pour out liquid such as water sucked into the tank body, which may cause the interior of the vacuum cleaner to be in humid conditions in a long term, and thereby shortening the service period of the vacuum cleaner.

Moreover, as a portable vacuum cleaner, it is desired to make further improvements to realize high efficiency in dust vacuuming, small size and compact structure, light weight, and improved service period of the vacuum cleaner.

Solutions for Addressing the Problems

The present disclosure is provided based on the above problems and intends to provide a vacuum cleaner that is easy to assemble, portable, convenient in checking the battery level, waterproof and has a good performance of drainage, high efficiency in dust vacuuming, small size and compact structure, light weight, and improved service period. It should be noted that, the present disclosure intends to solve one of the above objects and does not necessarily realize all of them.

In a first technical solution of the present disclosure, there is provided a portable vacuum cleaner comprising a tank body, a head portion disposed above the tank body, and a battery connection portion that is disposed at the head portion and is capable of connecting to a battery. At least a part of an upper end portion of the tank body has a bent shape or a curved shape, and the rest part of the upper end portion of the tank body has a shape neither bending inward nor curved inward.

In a second technical solution of the present disclosure, there is provided a portable vacuum cleaner comprising a tank body, a head portion disposed above the tank body, and a battery connection portion that is disposed at the head portion and is capable of connecting to a battery. A lower portion of the vacuum cleaner is connectable to a tool box.

In a third technical solution of the present disclosure, there is provided a portable vacuum cleaner comprising a tank body, a head portion disposed above the tank body, a battery connection portion that is disposed at the head portion, and a hose for collecting dust. The tank body is capable of retaining the hose.

Effects of the Disclosure

The vacuum cleaner of the present disclosure might be portable, convenient for checking the battery level and waterproof, and might achieve the effect of high efficiency in dust vacuuming, small size and compact structure, light weight, and improved service period.

DESCRIPTION OF REFERENCE SIGNS

10: vacuum cleaner; 20: drive head assembly; 30: battery; 40: filter system; 50, 50': suction hose; 60: suction head accessory; 70: tank body assembly; 61: wide-mouth suction head accessory; 62: narrow-mouth suction head accessory; 21: case; 22: motor; 23: fan; 211, 211': intake port; 212, 212': hose retaining part; 213, 213': fixing sheet; 214: suction head accessory retaining part; 215: grip; 216: grip retaining part; 217: battery housing space; 218: exhaust port; 219: strap mount; 90: handle; 220: cavity; 214A: first suction head accessory retaining part; 214B: second suction head accessory retaining part; 221: battery cover; 217D: drainage groove; 221A: side plate portion; 2141, 2142: pawl; 611: pipe portion; 217K: power switch; 217M: coupler; 100: electric wrench; 31: battery level display; 32: sliding guide; 33: engagement hook; 34: connection terminal; 217A: battery connection portion; 217N: sliding rail; 217P: engagement plate; 217Q: wiring portion; 217C: inclined surface; 217B: mirror member; 41: filter body; 42: interior bearing structure; 43: blocking device; 44: upper end cap; 45: lower end cap; 46: floating chamber; 47: floating cup; 48: cup body; 49: sponge; 51: connector body; 52: connector boss; 72: cam locking system; 72Z: another cam locking system; 71, 71': tank body; 214C: third suction head accessory retaining part; 721: lock body; 722: lock head; 711: flange; 74: engagement structure; 741: claw housing part; 742: claw; 743: threaded member; 741A: first housing part; 741B: second housing part; 742A: mounting hole; 742B: claw portion; 743: threaded member; 201: case body; 202: cover body; 203: locking structure; 204: locking member; 203A: first recess; 203B: second recess; 203C: third recess; 205: guiding groove; 80: connector; 81: first protrusion; 82: second protrusion; 83: third protrusion; 84: fourth protrusion; 203D: fourth recess; 224: rotor core; 222: stator coil; 223: stator core.

DETAILED DESCRIPTION

In the following, a vacuum cleaner of the present disclosure will be described with reference to FIGS. 1-20. It should be understood that the specific embodiment described below is a preferable embodiment of the present disclosure, and that the embodiment is merely described to explain the present disclosure, instead of limiting the present disclosure.

Figure 1:
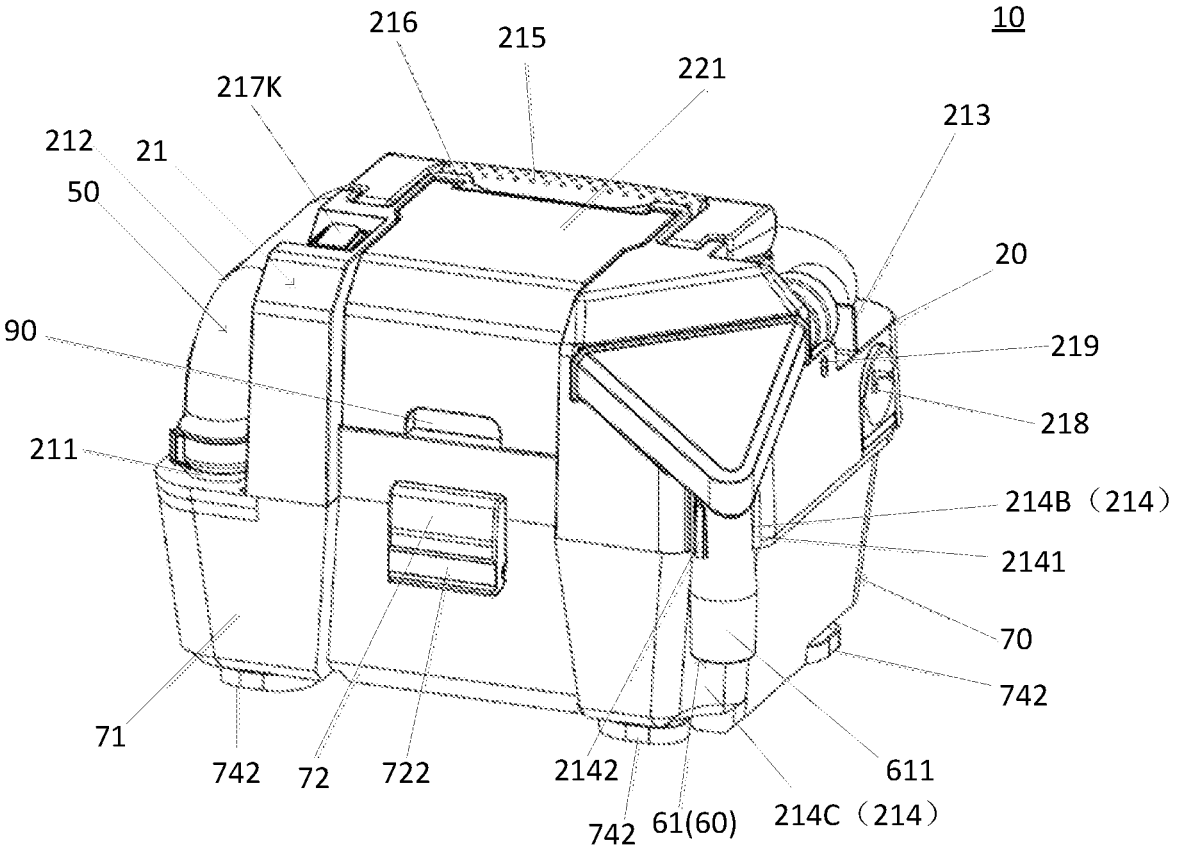
FIG. 1 is a perspective view of a vacuum cleaner of the present disclosure.
Figure 2:
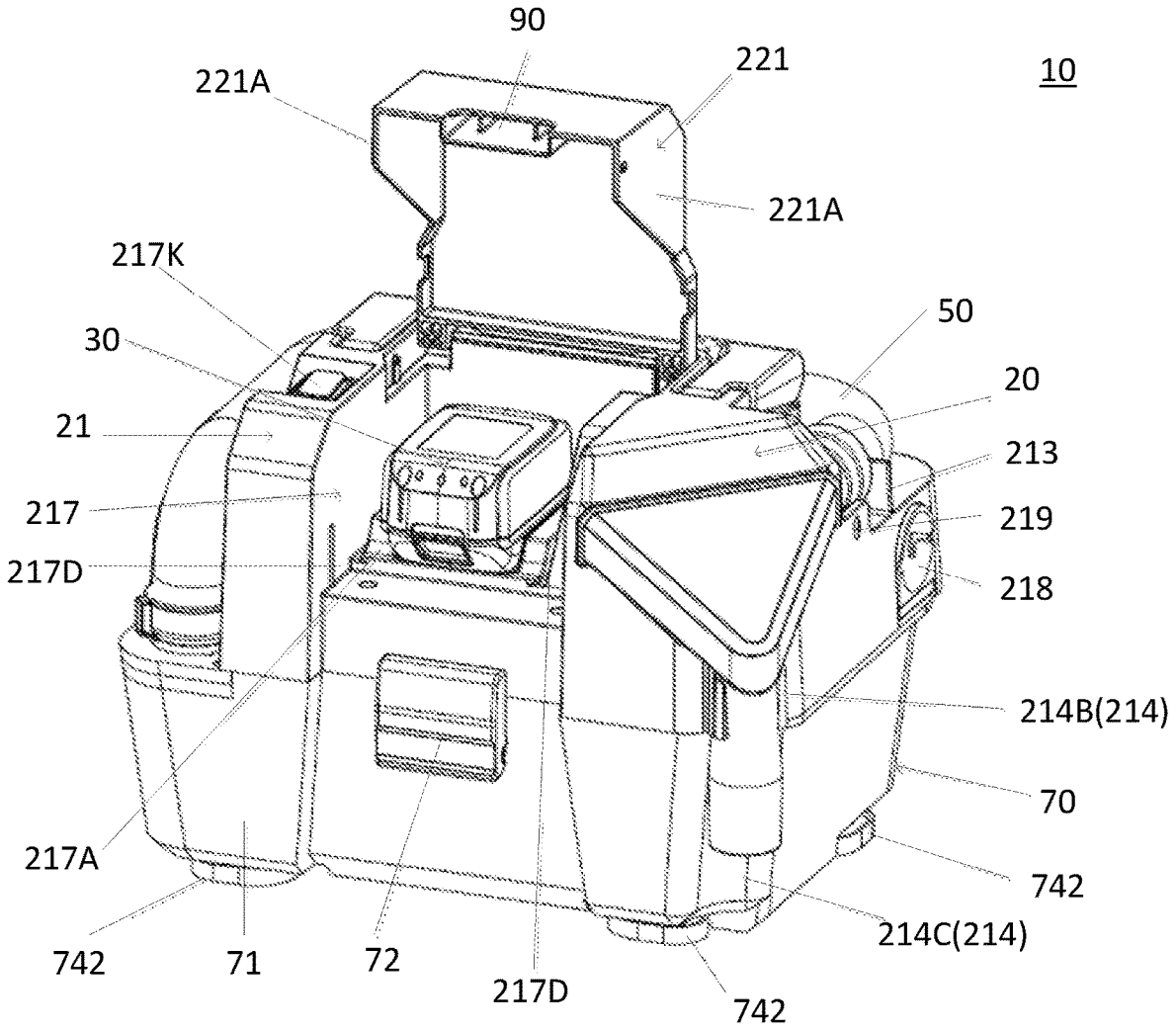
FIG. 2 is a perspective view of the vacuum cleaner of the present disclosure in a state where a battery cover is opened.
Figure 3:
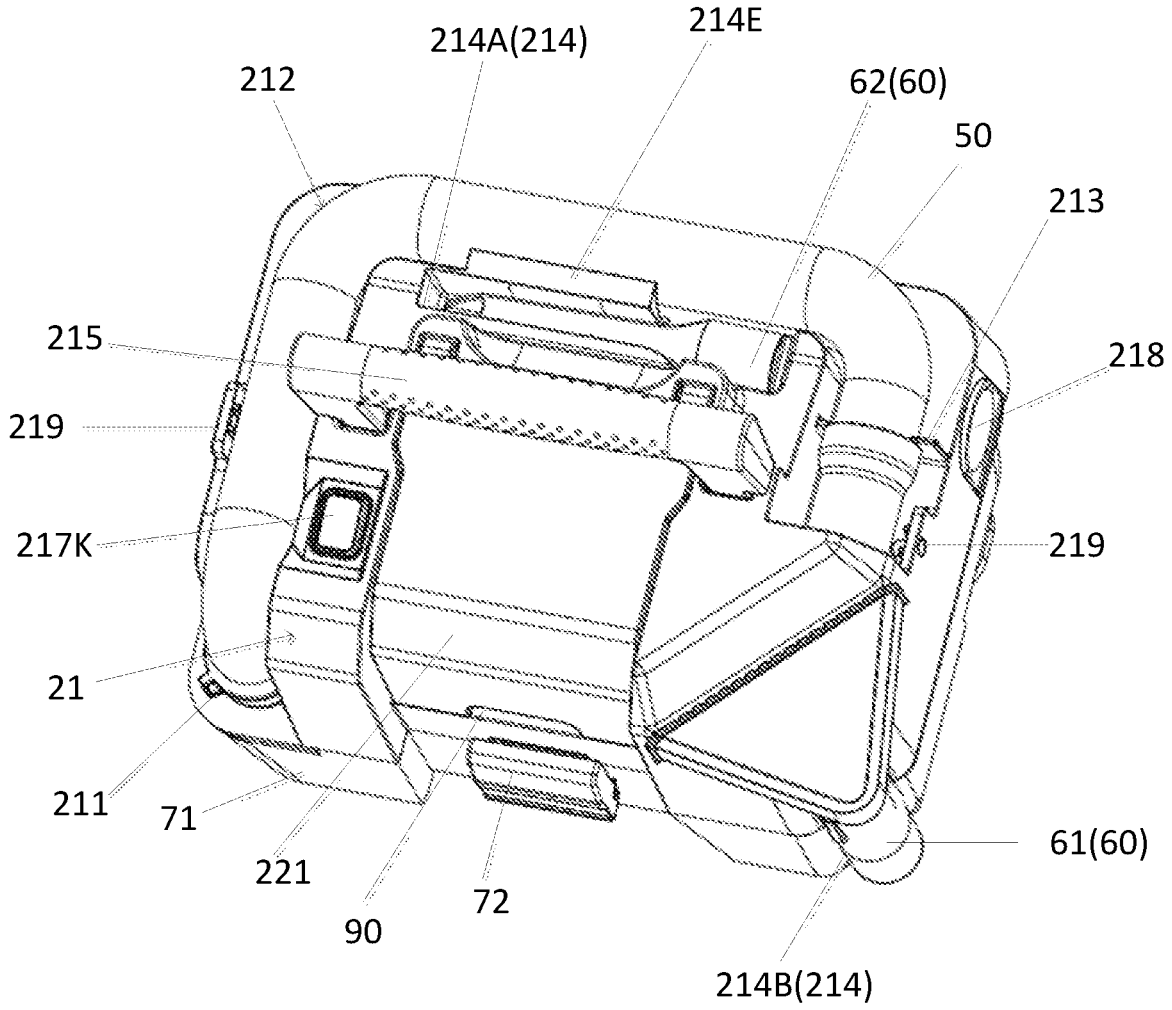
FIG. 3 is an oblique top view of the vacuum cleaner of the present disclosure.
Figure 4:
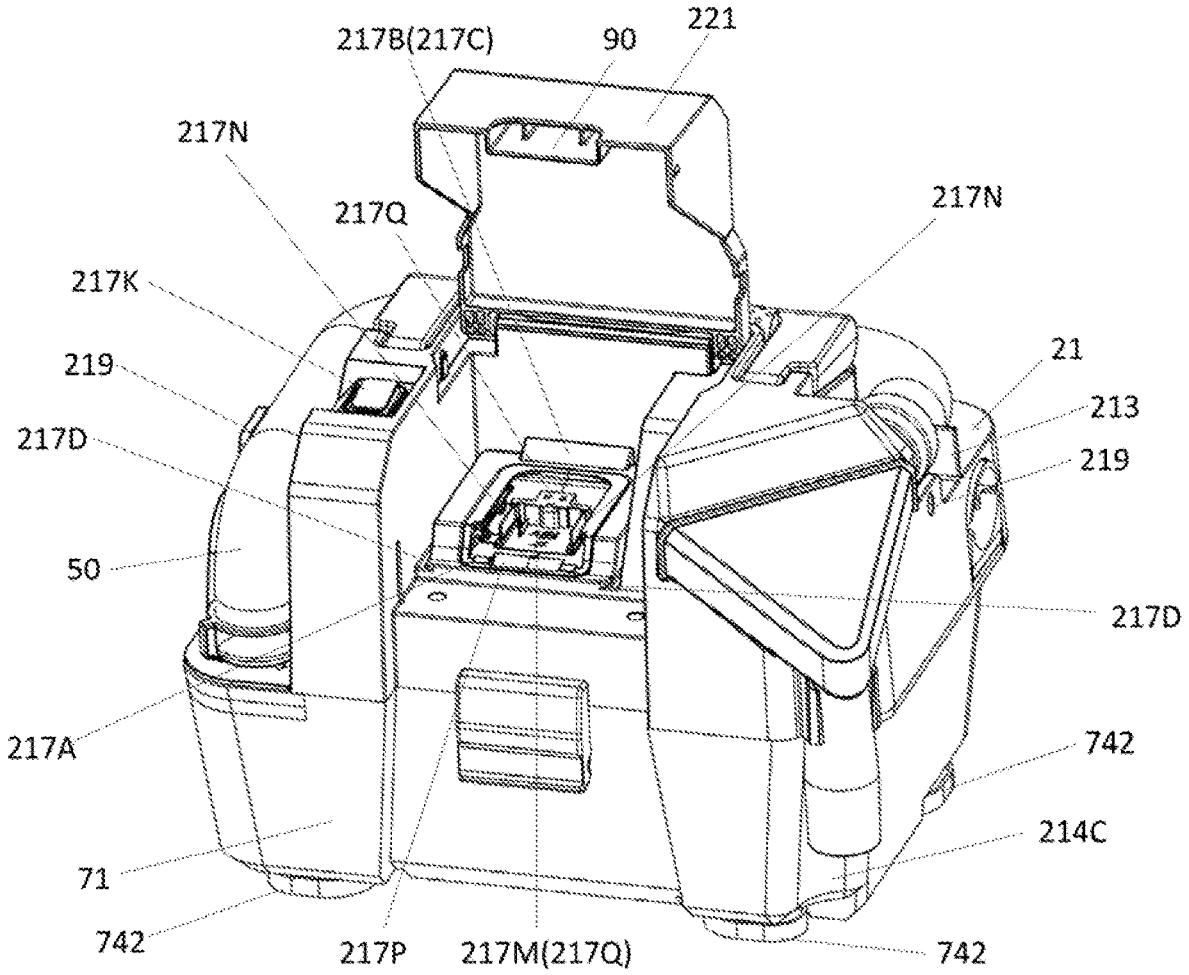
FIG. 4 is a view of the vacuum cleaner of the present disclosure where a battery housing space is observed.
Figure 5:
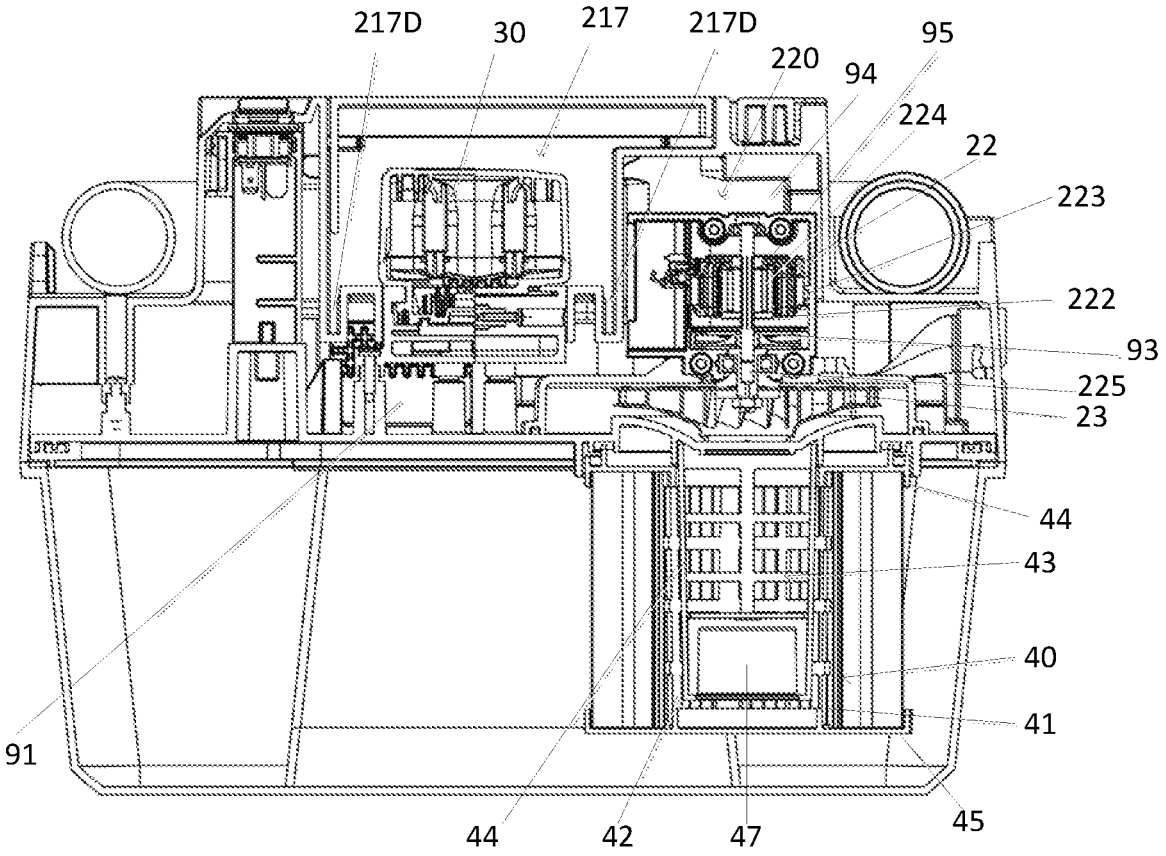
FIG. 5 is a sectional view of the vacuum cleaner of the present disclosure.
Figure 6:
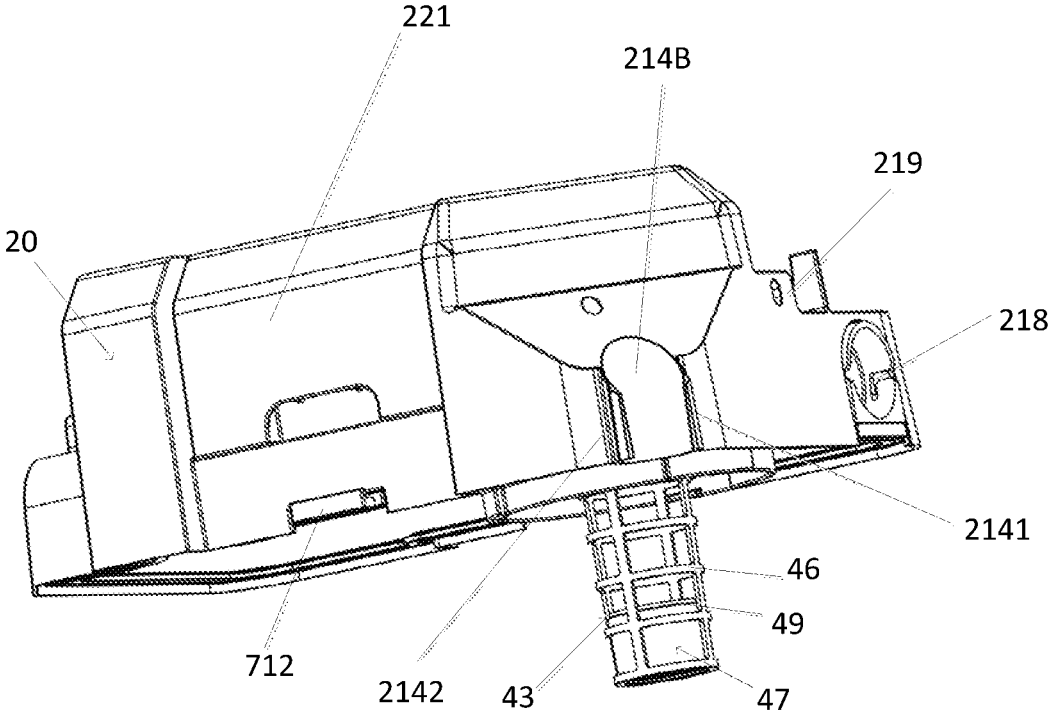
FIG. 6 is a perspective view of a drive head assembly of the vacuum cleaner of the present disclosure.

FIG. 1 is a perspective view of a vacuum cleaner of the present disclosure. FIG. 2 is a perspective view of the vacuum cleaner of the present disclosure in a state where the battery cover is opened. FIG. 3 is an oblique top view of the vacuum cleaner of the present disclosure. FIG. 4 is a view of the vacuum cleaner of the present disclosure where a battery housing space is observed. FIG. 5 is a sectional view of the vacuum cleaner of the present disclosure. FIG. 6 is a perspective view of the drive head assembly of the vacuum cleaner of the present disclosure.

It should be noted that without special notes, the upper/lower/left/right side of the figure plane of FIG. 1 is corresponding to the upper/lower/left/right side of the vacuum cleaner; the inner side of the figure plane of FIG. 1 is corresponding to the rear side of the vacuum cleaner; and the outer side of the figure plane of FIG. 1 is corresponding to the front side of the vacuum cleaner.

Referring to FIGS. 1-6, a vacuum cleaner 10 of the present disclosure comprises a drive head assembly 20, a battery 30, a filter system 40, a suction hose 50, a suction head accessory 60 and a tank body assembly 70. In a particular embodiment, the suction head accessory 60 includes a wide-mouth suction head accessory 61 and a narrow-mouth suction head accessory 62.

Detailed description is as follows.

1. Drive Head Assembly 20

Referring to FIGS. 1-6, the drive head assembly 20 is detachably mounted to the tank body assembly 70. The drive head assembly is a head portion in this technical solution. The drive head assembly 20 includes a case 21, a motor 22, a fan 23 and a controller.

The case 21 has a substantially rectangular parallelepiped shape having a closed space therein and is formed with a hose retaining part 212, a fixing sheet 213, a suction head accessory retaining part 214, a grip 215, a grip retaining part 216, a battery housing space 217, an exhaust port 218, a strap mount 219 and a cavity 220. In a particular embodiment, the suction head accessory retaining part 214 includes a first suction head accessory retaining part 214A for retaining the narrow-mouth suction head accessory 62 and a second suction head accessory retaining part 214B for retaining the wide-mouth suction head accessory 61.

The grip 215 is provided at a central part of an upper surface of the case 21. The grip 215 is pivotably joined to the upper surface of the case 21 and is switchable between a upright state where the grip 125 erects to be gripped (see FIG. 3) and a retained state where the grip 125 lies within a recess, i.e., the grip retaining part 216 in the upper surface of the case 21, the recess having a shape corresponding to the grip 215 (see FIG. 1). The grip retaining part 216 is formed to have a depth such that in a state where the grip 215 is retained in the grip retaining part 216, an upper surface of the grip 215 is substantially aligned with the upper surface of the case 21. In addition, a part of the grip retaining part 216 in the case 21 is further depressed to form a first suction head accessory retaining part 214A. Herein, as a particular embodiment, the first suction head accessory retaining part 214A is used for retaining the narrow-mouth suction head accessory 62. That is, in a state where the narrow-mouth suction head accessory 62 is retained in the first suction head accessory retaining part 214A, when the grip 215 lies down in the grip retaining part 216, the grip 215 is on an upper side of the narrow-mouth suction head accessory 62. A first suction head accessory holding structure (not shown) is provided in the first suction head accessory retaining part 214A for holding and fixing the narrow-mouth suction head accessory 62.

By providing the first suction head accessory retaining part 214A on a lower side of the grip retaining part 216 and continuing to the grip retaining part 216, the suction head accessory 60 and the grip 215 can be compactly received. Moreover, since a space of the case 21 at an inner side relative to the outer contour of the rectangular parallelepiped shape of the case 21 is made full used of, the vacuum cleaner is miniaturized and light-weighted.

At a portion of the case 21 that is nearer to the front side than the grip retaining part 216, there is provided a space for mounting the battery 30, i.e., a battery housing space 217, which depresses downwardly from the upper surface of the case 21 and opens toward a front surface of the case 21. In the battery housing space 217, there is provided a battery connection portion 217A and a mirror member 217B. The specific structure of the battery connection portion 217A and the mirror member 217B will be further detailed when the battery 30 is described.

There is provided a battery cover 221 for covering the battery housing space 217 on the case 21. The battery cover 221 has one end pivotably joined to an upper end of a rear wall of the battery housing space 217. By pivoting the battery cover 221 relative to the upper end of the rear wall of the battery housing space 217, it is possible that the battery cover 221 switches between an open state where the battery cover 221 is open to expose the battery 30 (see FIG. 2) and a close state where the battery cover 221 is closed and the battery housing space 217 is covered (see FIG. 1). There is a handle 90 on a front surface of the battery cover 221 (i.e., the front surface of the case 21), the handle 90 being formed into a shape that a part of the front surface of the battery cover 221 depresses from the outer side toward the battery housing space 217 side. The battery cover 221 is easily opened by putting fingers into the depression of the handle 90.

There is a groove, i.e. a drainage groove 217D, depressing toward a lower side provided at rear, left and right edge portions on a bottom surface of the battery housing space 217. The drainage groove 217D has a U shape. The drainage groove 217D opens at both ends on the front surface of the case 21. The battery cover 221 includes side plate portions 221A on the left and the right side. When the battery cover 221 is closed, the side plate portions 221A on both sides of the battery cover 221 are located right above the drainage groove 217D, respectively.

By providing the drainage groove 217D, in a state where the battery cover 221 is closed, when there is liquid entering into the battery housing space 217 via a gap between the battery cover 221 and the case 21, the liquid drops into the drainage groove 217D and is guided by the drainage groove 217D so as to be discharged from a front surface of the vacuum cleaner 10. Thus, it can be prevented that liquid contacts and damages the battery 30, or that liquid enters into the battery connection portion and damages the circuit.

In addition, the battery housing space 217 is located at a central portion of the case 21; and the battery 30 inserts into the battery housing space 217 in a horizontal direction in a sliding manner, thereby reducing the height taken by the battery 30, which realizes miniaturization, as well as acquiring balance in weight of the whole vacuum cleaner.

A corner of the rectangular parallelepiped shape of the case 21 depresses from the outer side toward the inner side to form a shape having a lost corner portion (see FIGS. 1, 2 and 5, the left front corner portion in the present embodiment). A base end portion of the suction hose 50 is coupled at the lost corner portion to an intake port 211 provided on the tank body assembly 70.

A part of the rear, left and right side portions of the upper surface of the case 21 depresses toward the lower side to form the hose retaining part 212 for retaining the suction hose 50. In a retaining state of the suction hose 50, the suction hose 50 extends, along the hose retaining part 212, about a circumferential surface of the case 21 from the intake port 211 to the side of the case 21 opposite to the side of the intake port 211 with regard to the battery housing space 217. At a terminal end of the hose retaining part 212, there is vertically provided a fixing sheet 213 for fixing a distal end portion of the suction hose 50. The fixing sheet 213 is provided with a C-shaped cutout opening upwards. By fitting the distal end portion of the suction hose 50 into the C-shaped cutout as shown in FIGS. 1, 2 and 4 and blocking a large-radius portion at the distal end portion of the suction hose 50 with the fixing sheet 213, the distal end portion of the suction hose 50 can be reliably fixed to the fixing sheet 213.

In a portion of the case 21 at a lateral side of the hose retaining part 212 and close to the suction head accessory retaining part 214, there is provided a hose holding member 214E formed to have a shape stretching from the case 21 toward a side of the suction hose 50. When the suction hose 50 is retained in the hose retaining part 212, the stretching portion is capable of abutting against a top portion of the suction hose 50 from the above, so as to prevent the suction hose 50 from dropping from the above. Although not shown, the hose holding members erecting from the outer circumferential surface of the case 21 may be provided at a certain interval at an outer periphery of the hose retaining part 212, for holding and fixing the suction hose 50 retained in the hose retaining part 212.

By providing the hose retaining part 212 in such a manner, the space of the case 21 at an inner side relative to the outer contour of the rectangular parallelepiped shape of the case 21 is made full used of. As a result, the vacuum cleaner is miniaturized and light-weighted.

At a corner portion of the case 21 that opposes the lost corner portion with the battery housing space 217 interposed therebetween (the part facing the intake port 211) and where the hose retaining part 212 is not provided (the right front corner portion in the present embodiment), there is provided another suction head accessory retaining part 214. Herein, as an example, this suction head accessory retaining part 214 is the second suction head accessory retaining part 214B for retaining the wide-mouth suction head accessory 61. In addition, in the second suction head accessory retaining part 214B, by designing the corner portion of the case 21 to have the portion corresponding to the shape of the wide-mouth suction head accessory 61 to depress inwardly, when the wide-mouth suction head accessory 61 is engaged in the second suction head accessory retaining part 214B, the wide-mouth suction head accessory 61 itself forms a corner portion of the vacuum cleaner and forms a part of the outer contour of the rectangular parallelepiped shaped of the case 21. Accordingly, as described below, a third suction head accessory retaining part 214C for retaining a part of the wide-mouth suction head accessory 61 is provided at a portion of the tank body assembly 70 corresponding to the second suction head accessory retaining part 214B. On the second suction head accessory retaining part 214B or the third suction head accessory retaining part 214C, there is provided a second suction head accessory holding structure for holding and fixing the wide-mouth suction head accessory 61. In the present embodiment, the second suction head accessory holding structure is two pawls 2141 and 2142 that are provided at a certain interval on the case 21 in a circumferential direction. By arranging a pipe portion 611 of the wide-mouth suction head accessory 61 between the pawls 2141, 2142 such that the pawls 2141, 2142 hug the pipe portion 611, the wide-mouth suction head accessory 61 is held there.

By providing the second suction head accessory retaining part 214B and the third suction head accessory retaining part 214C in such a manner, the space at an inner side relative to the outer contour of the box shape of the whole vacuum cleaner is made full used of. As a result, the vacuum cleaner is miniaturized and light-weighted.

At a side surface (the right side in the present embodiment) of the case 21 opposing to the side of the lost corner portion (a part facing the intake port 211), there is provided an exhaust port 218 opening to a lateral side. In addition, there is provided an exit mark in vicinity the exhaust port 218. Further, there is provided on the left and right sides of the case 21 strap mounts 219 for mounting a shoulder strap. The shoulder strap has one end fixed to the strap mount 219 on the left side and the other end fixed to the strap mount 219 on the right side. Thus, the operator is enabled to hang the shoulder strap on the shoulder and hold the suction hose 50 in the hand to perform dust vacuuming.

In the cavity 220 of the case 21, there is received a motor 22, a fan 23 and a controller. The motor 22, the fan 23 and the controller are described below in detail.

The motor 22 uses a brushless motor. The motor 22 is an inner-rotor brushless three-phase motor. The motor 22 comprises a rotor core 224, a stator coil 222 and a stator core 223. The rotor core 224 is made of a magnetic material. The stator core 223 is fixed relative to the case 21. The stator coil 222 is wrapped around the stator core 223 and excites the stator core 223 by being energized. The rotor core 224 is fixed relative to an output shaft 225 and rotates along with the output shaft 225. The stator core 223 has a cup shape, having a cylindrical peripheral wall surrounding the rotor core 224 and a bottom wall provided at one end of the peripheral wall. The magnet is fixed to the inner circumferential face of the inner rotor 224 and is facing the rotor core 224 located at an inner side of the stator core 223.

The output of the motor 22 is transmitted to the fan 23 by means of the output shaft 225 to drive blades of the fan 23 to rotate, so as to produce a vacuum environment in the vacuum cleaner. The fan 23 uses a common fan in this field and is not further described herein.

The motor 22 uses a brushless motor, thereby miniaturizing the motor and improving the service period of the motor, which improves the design freedom for a compact arrangement of the suction hose 50, the suction head accessory 60, etc., so as to realize miniaturization and weight lightening of the vacuum cleaner and enhancing the efficiency of the vacuum cleaner.

A motor cooling fan 93 is provided at the motor 22. By the rotation of the motor cooling fan 93, air flows to a passage 94 via an inlet provided in the drive head assembly 20; the air flows between the rotor core 224 and the stator core 223 of the motor via the passage 94 and is discharged outside via an outlet provided in the drive head assembly 20 by the cooling fan 93. Herein, the inlet for cooling the motor, the outlet for cooling the motor, the intake port 211 for the suction and the exhaust port 218 for the suction are ports independent from one another. Moreover, the flow path from the inlet for cooling the motor to the outlet for cooling the motor and the flow path between the intake port 211 and the exhaust port 218 are independent flow paths.

Referring to FIGS. 1-4 and 8, the controller includes a power switch 217K, a coupler 217M disposed at the battery connection portion 217A and a control substrate 91. The battery 30 is connected to the control substrate 91 by means of the coupler 217M. Wirings connected to the control substrate 91 are connected to a motor substrate 95. Thereby, the battery 30 and the motor 22 are electrically connected, and the power switch 217K enables that the user selectively allows or does not allow a current to flow to the motor 22. The control substrate 91 is disposed at a position on a side opposing the side of the inclined surface 217C with regard to the battery connection portion 217A in the vertical direction. In addition, the wirings connected to the control substrate 91 are disposed at a position on a side opposing the side of the battery 30 with regard to the control substrate 91 in a front-rear direction. As shown in FIGS. 1-6, the case 21 is provided with a recess for arranging the power switch 217K. The power switch 217K may be a knob switch or a toggle switch.

2. Battery 30

The vacuum cleaner of the present disclosure is usually used in cooperation with various power tools. The power tools include, but not limited to, electric drill, wrench, reciprocating saw, saw, band saw, jigsaw, disk saw, grinder, riveter, etc. The battery 30 used by the vacuum cleaner of the present disclosure is a battery 30 that can be also mounted to the above power tools. To facilitate understanding, the structure of the battery 30 being disposed in the power tool and the structure of the battery 30 being disposed in the vacuum cleaner is described below. The description of the power tool takes an electric wrench 100 (see FIG. 9) as an example.

Figure 8:
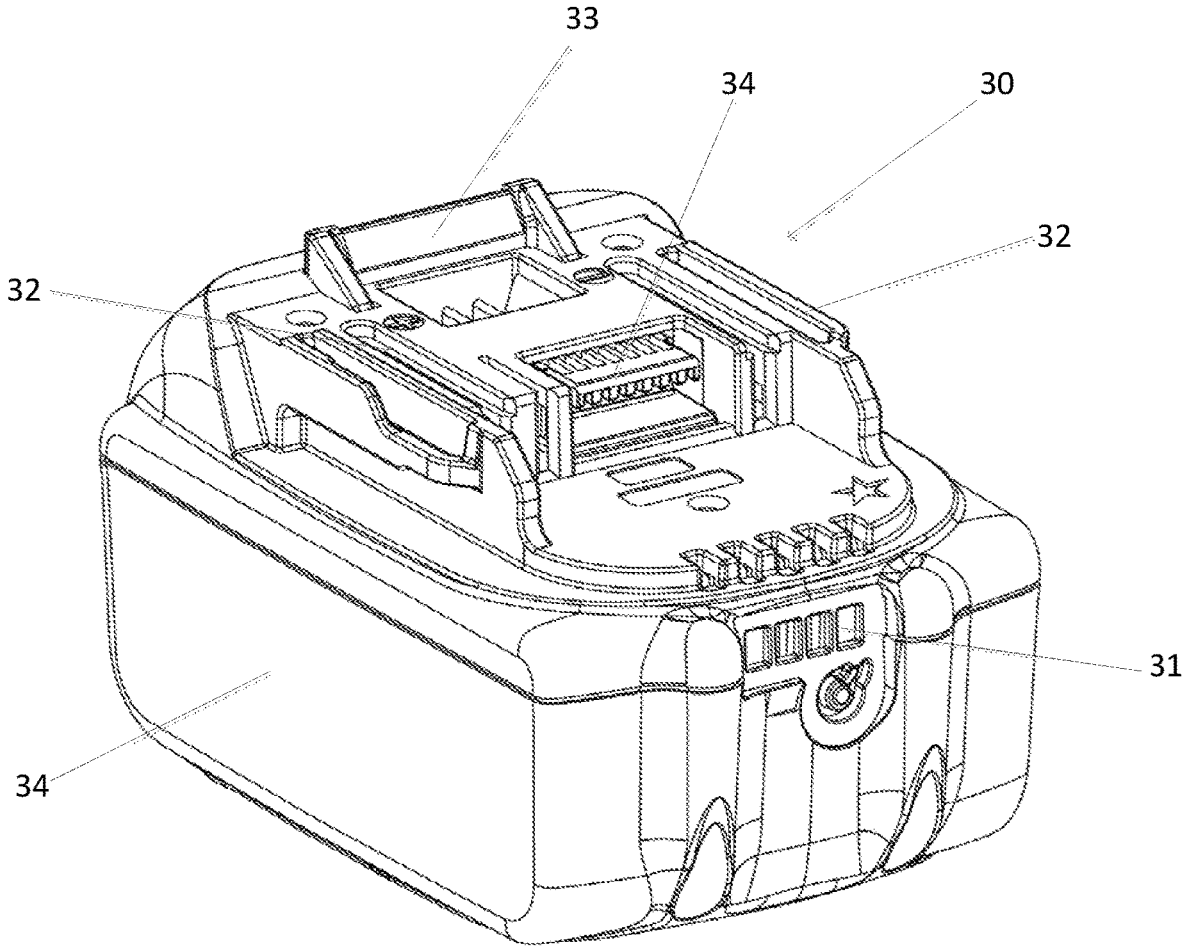
FIG. 8 is a perspective view of a battery of the present disclosure.
Figure 9:
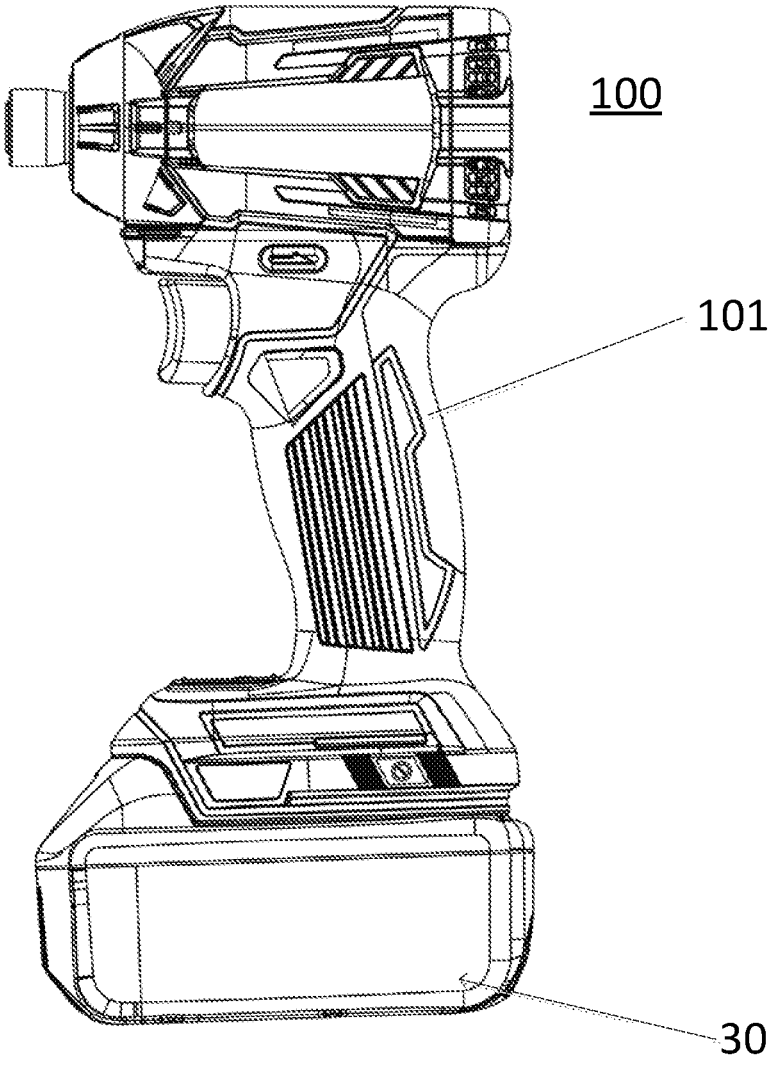
FIG. 9 is a view of a battery for a electric wrench.

As shown in FIG. 8, the battery 30 is a rechargeable battery slidably installed to the body of the power tool, having a nominal voltage of, for example, 18V. It should be noted that, in the present disclosure, for the battery 30, the target direction of the battery 30 in the direction of the sliding installation is deemed as the front of the battery 30, and a direction opposite to the front in the sliding direction is deemed as the rear of the battery 30. The front and rear are merely relative concepts with regard to the sliding direction of the battery 30 and are not absolute.

On a front surface of the battery 30, there is provided a battery level display 31 for displaying the remaining electricity quantity of the battery 30. Moreover, there is provided a sliding guide 32 and an engagement hook 33 on the battery 30. That is, the battery 30 uses the sliding guide 32 to guide the sliding installation and uses the engagement hook 33 to maintain the state of sliding installation with regard to the device body. Further, there is provided a connection terminal 34 on the battery 30. The connection terminal 34 is used for electrical contact with a not-shown battery charge or a not-shown device body when the battery 30 is recharged or when the battery 30 supplies power for the device body.

Correspondingly, there is provided a first battery connection portion in a main body 101 of the electric wrench 100.

The first battery connection portion comprises left and right first sliding rails, a first coupler disposed between the two first sliding rails and a first engagement plate disposed between the two first sliding rails, and a first wiring portion being provided on the first coupler. Since the first battery connection portion and the battery connection portion of the vacuum cleaner have the same structure, the illustration will be omitted.

For the electric wrench 100, the side of a handle of the electric wrench 100 is deemed as the front side of the electric wrench 100, the side of the body of the electric wrench 100 is deemed as the rear side. When the battery 30 is mounted to the first battery connection portion, in a state where the sliding guides of the battery 30 is engaged with first sliding rails of first battery connection portion, the battery 30 is enabled to slide from the front side to the rear side of the electric wrench 100 along the first sliding rails till the connection terminal 34 of the battery 30 couples with the first wiring portion on the first coupler of the first battery connection portion, and the engagement hook 33 of the battery 30 is engaged with the first engagement plate of the first battery connection portion, thereby obtaining a state where the sliding installation is completed.

At this time, in order to check the remaining electricity quantity conveniently, the battery level display 31 is located at a front portion of the battery 30, i.e., on the rear side of the body of the electric wrench 100.

There is also a battery connection portion 217A mating with battery 30 inside the battery housing space 217 of the vacuum cleaner. The battery connection portion 217A is provided on a bottom surface portion of the battery housing space 217 and comprises left and right sliding rails 217N, the coupler 217M between the two sliding rails 217N and the engagement plate 217P between the two sliding rails 217N, a wiring portion 217Q being provided on the coupler 217M, which is the same with the electric wrench 100.

When the battery 30 is installed in the battery connection portion 217A, in a state where the sliding guides 32 of the battery 30 is engaged with the sliding rails 217N of the battery connection portion 217A, the battery 30 is enabled to slide from the front side to the rear side of the vacuum cleaner along the sliding rails 217N till the connection terminal 34 of the battery 30 couples with the wiring portion 217Q on the coupler 217M of the battery connection portion 217A, and the engagement hook 33 of the battery 30 is engaged with the engagement plate 217P of the battery connection portion 217A, thereby obtaining a state where the sliding installation is completed. Thus, the battery 30 is inserted into and joined to a terminal of the drive head assembly 20 in a horizontal direction.

At a position on the rear wall of the battery housing space 217, which faces the battery level display 31 in the state where the sliding installation is completed, there is provided an inclined surface 217C that is inclined backwards and upwards as viewed from the front side of the vacuum cleaner. A mirror member 217B is provided on the inclined surface 217C. The mirror member 217B is made of resin and undergoes a surface treatment of shining galvanization.

Since the battery level display 31 is located in a narrow space between the battery 30 and the rear wall of the battery housing space 217, it is not easy for the operator to read the display value of the battery level display 31. By providing the above inclined surface 217C and the above mirror member 217B, the display value of the battery level display 31 is reflected from the mirror member 217B, allowing the operator to easily read the display value of the battery level display 31 from the mirror member 217B.

It is understood that since the position of the battery level display 31 varies in the battery 30, the position where the mirror member 217B is arranged is not limited to the rear wall of the battery housing space 217. The mirror member 217B may be correspondingly arranged on the wall portion of the battery housing space 217 according to the position of the battery level display 31.

3. Filter System 40

The filter system 40 is provided in the drive head assembly 20 and comprises a filter body 41, an interior bearing structure 42 and a blocking device 43.

The filter body 41 may be formed by a wrinkle material that allows air and vapor to penetrate and allows liquid to go through or penetrate. As known by one skilled in the art, a filter can be made from any appropriate filter material, for example, conventional filter paper, sintered porous plastic, etc. In addition, if need, secondary filters may be multi-set at upstream of the filter between the filter and the fan 23 for further fine filtering dust.

The interior bearing structure 42 has a hollow cage-shaped structure, being disposed around the interior of the filter body 41 and in a fixed connection with an upper end cap 44 and/or an lower end cap 45. During the operation of the vacuum cleaner 10, the interior bearing structure 42 supports the filter body 41 in an axial direction and a radial direction to prevent the filter body 41 from being crushed or distorted by a pressure difference generated between the inner surface and the outer surface of the filter body 41.

The lower end cap 45 may have a plate-shaped structure and be made from a rigid material. The lower end cap 45 is bonded to a lower end of the filter body 41 in a sealed manner. The upper end cap 44 may be an annular flange and bonded to an upper end of the filter body 41.

Figure 7:
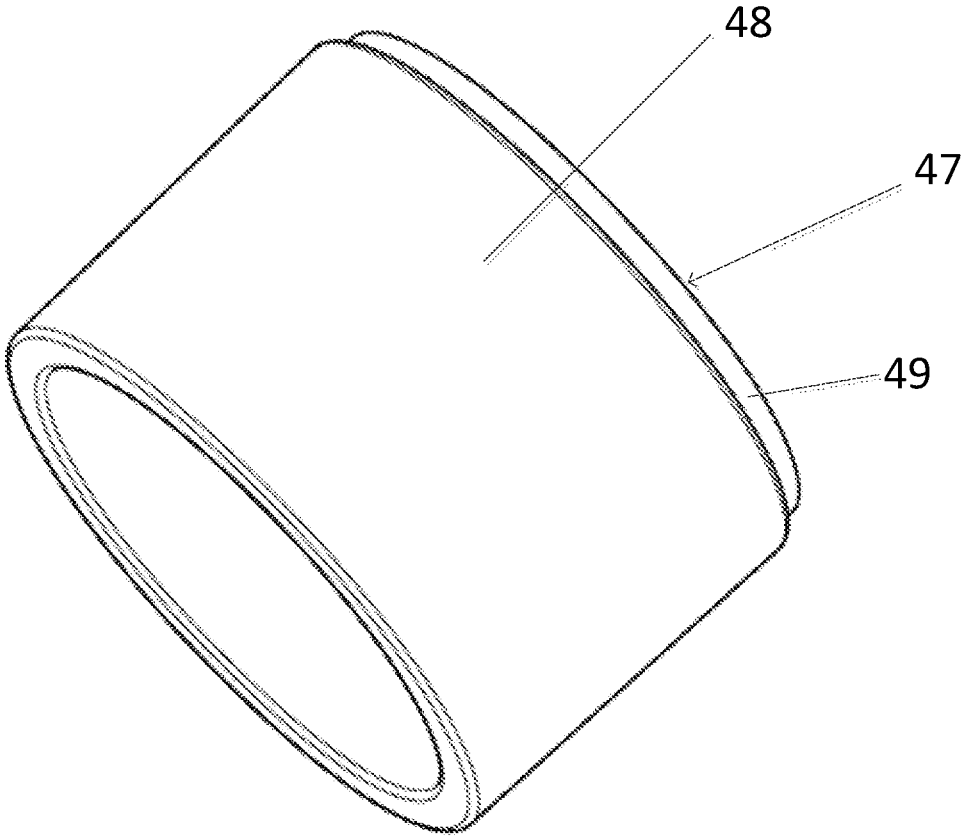
FIG. 7 is a perspective view that illustrates a floating cup.

The blocking device 43 is connected to the drive head assembly 20. When liquid in the tank body 71 reaches a predetermined liquid level, the blocking device 43 blocks the air passing the drive head assembly 20 such that the filter system 40 is isolated from the fan 23. The blocking device 43 comprises a floating chamber 46 and a floating cup 47. The floating chamber 46 has a hollow cage-shaped structure to allow air to flow therein. The floating chamber 46 holds and guides the floating cup 47 in an axial direction. As shown in FIG. 7, the floating cup 47 has a cylindrical cup body 48 that opens to the downwards and a sponge 49 arranged on an outer side of a bottom surface of the cup body 48. The sponge 49 may have the same shape with the cup body 48. When liquid in the tank body 71 reaches a predetermined liquid level, the floating cup 47 rises in the floating chamber 46 under the buoyant force of the liquid to close an inlet of the fan 23.

By using the cylindrical floating cup 47 opening to the downward, when the liquid level reaches a position with a distance to the lower surface of the drive head assembly 20 is equal to the total thickness of the sponge and the closed bottom portion of the floating cup 47, the floating cup 47 blocks air flow between the filter system and the fan 23. As compared with a floating ball having a larger dimension in the up-and-down direction, the floating cup 47 increases the effective volume of the liquid contained by the tank body 71. Further, since the floating cup 47 has a larger stressed area, the buoyant force applied to the floating cup 47 is larger. Thus, the floating cup 47 is more sensitive to the rise of the liquid level. Moreover, since the sponge 49 is provided at the bottom portion of the floating cup 47, when the floating cup 47 abuts the drive head assembly 20 under a buoyant force, the impact force between the floating cup 47 and the drive head assembly 20 is reduced, as well as a sealing function realized.

4. Suction Hose 50 and Suction Head Accessory 60

The suction hose 50 is preferably a flexural vacuum hose and is detachably connected to the intake port 211 or the exhaust port. The suction hose 50 has one connection end that can be inserted into the intake port 211 provided in the tank body 71 or the exhaust port 218 provided in the drive head assembly 20. The one connection end is screwed by a relative rotation so as to be fixed to the intake port 211 or the exhaust port 218.

The other connection end of the suction hose 50 can be fictionally assembled or screwed to the suction head accessory 60. Such a suction head accessory is commonly known in this field and is not further described herein. The present disclosure describes the wide-mouth suction head accessory 61 and the narrow-mouth suction head accessory 62 as examples, but is not limited to the thereby.

5. Tank Body Assembly 70

Figure 10:
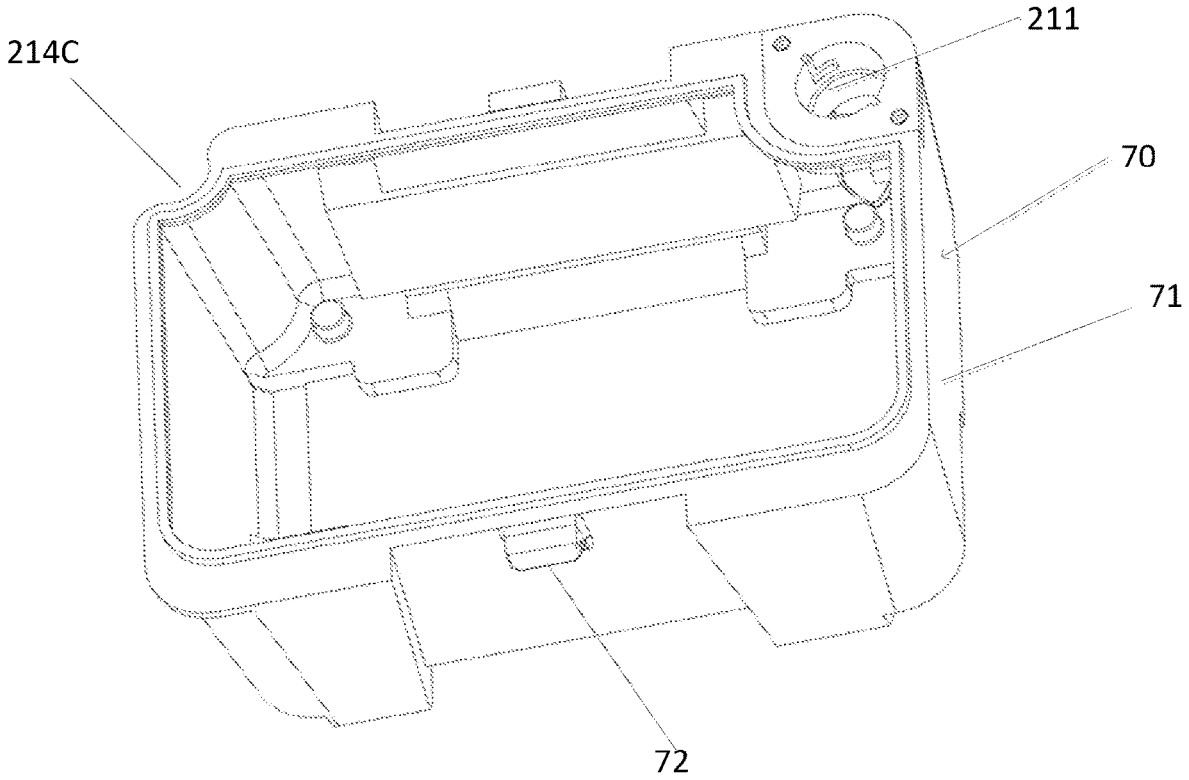
FIG. 10 is a perspective view of a tank body of the present disclosure.
Figure 11:
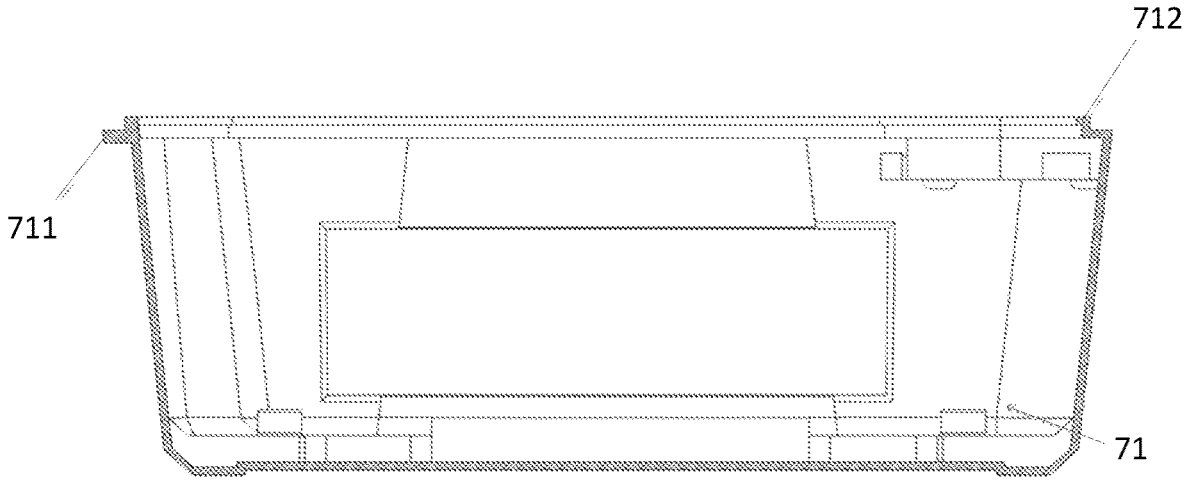
FIG. 11 is a sectional view of the tank body of the present disclosure.
Figure 12:
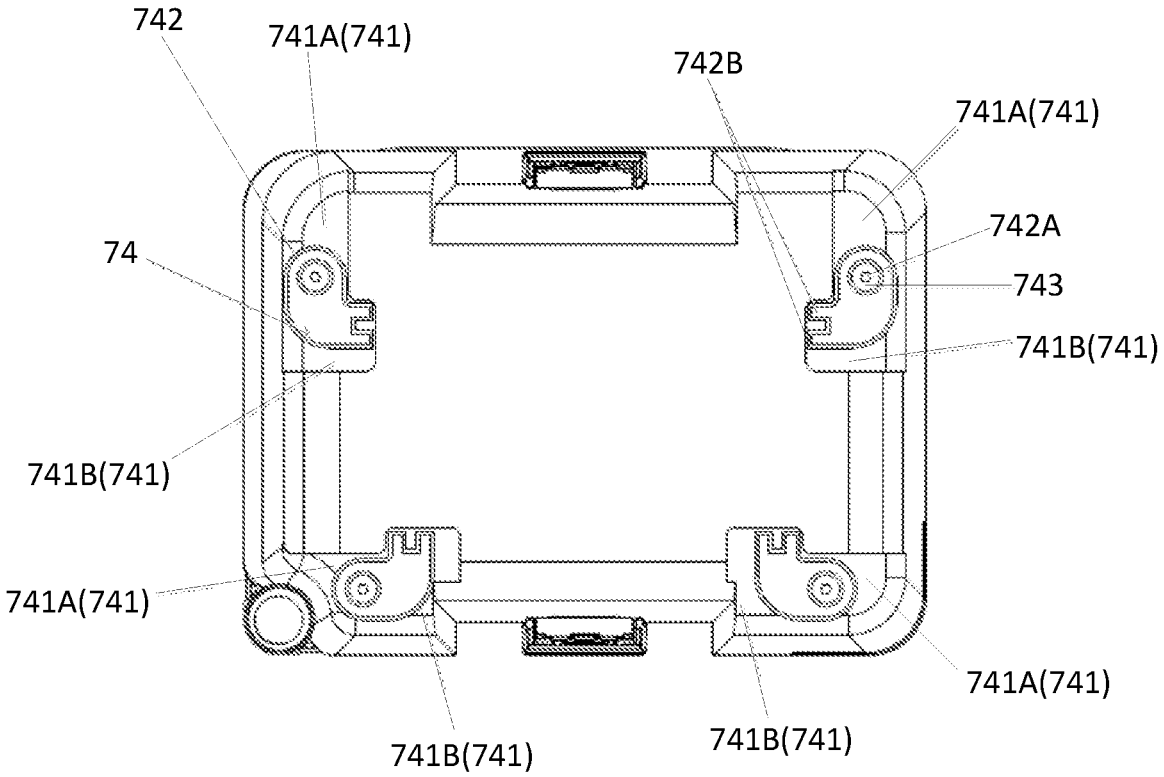
FIG. 12 is a bottom view of the vacuum cleaner of the present disclosure in a state where a claw is received.

As shown in FIGS. 1, 10 and 12, the tank body assembly 70 comprises a tank body 71, cam locking systems 72 respectively disposed at the center of the front and rear surfaces of the tank body 71 and a tool box installation accessory.

The tank body 71 is a container having a substantially rectangular parallelepiped shape opening upwards, and is used for storing the liquid and dust vacuumed therein. In addition, as mentioned above, there is provided a third suction head accessory retaining part 214C for retaining a part of the wide-mouth suction head accessory 61 at a portion of the tank body 71 corresponding to the second suction head accessory retaining part 214B of the case 21.

As described above, tank body 71 has an intake port 211 at one of its corner portions. The suction hose 50 has one connection end that can be inserted into the intake port 211 and is screwed by a relative rotation so as to be fixed to the intake port 211. In addition, it can be understood that other connection method such as frictional connection can be used.

The cam locking system 72 uses a lock body 721 and a lock head 722 so as to releasably fix the tank body 71 to the drive head assembly 20. The cam locking system 72 may use a common structure and is not further described herein.

The periphery at the opening side of the tank body 71 has an outer flange 711 protruding outwards and an inner flange 712 protruding inwards. The outer flange 711 functions to easily pour the liquid or duct collected in the tank body 71 without any remain. Moreover, the outer flange 711 may also reinforce the strength of the tank body 71. The tank body 71 having the outer flange 711 protruding outwards is usually formed by a method such as blow molding. The inner flange 712 can well guarantee the seal performance between the drive head assembly 20 and the tank body assembly 70. By providing the outer flange 711 and the inner flange 712, the above pouring performance is ensured as well as the seal performance with regard to the exterior of the vacuum cleaner.

Regarding the tool box installation accessory, the present disclosure gives two embodiment of claw 742 and connector 80, but is not limited herein. One skilled in the art may conduct reasonable modifications within their knowledge. The two embodiments are described below.

Figure 13:
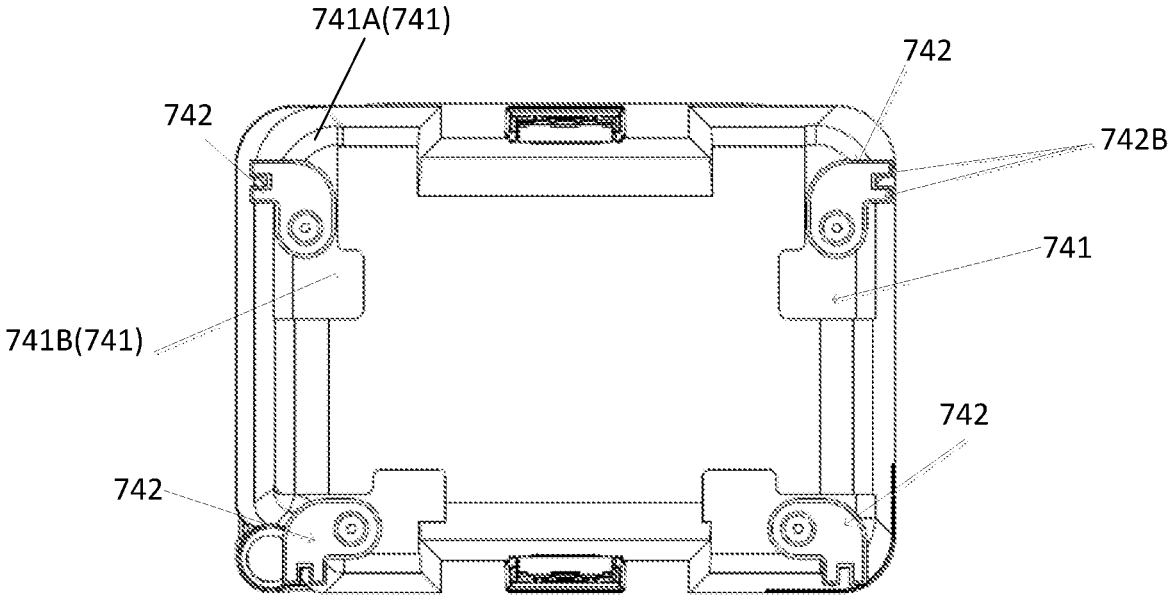
FIG. 13 is a bottom view of the vacuum cleaner of the present disclosure in a state where the claw is opened.
Figure 14:
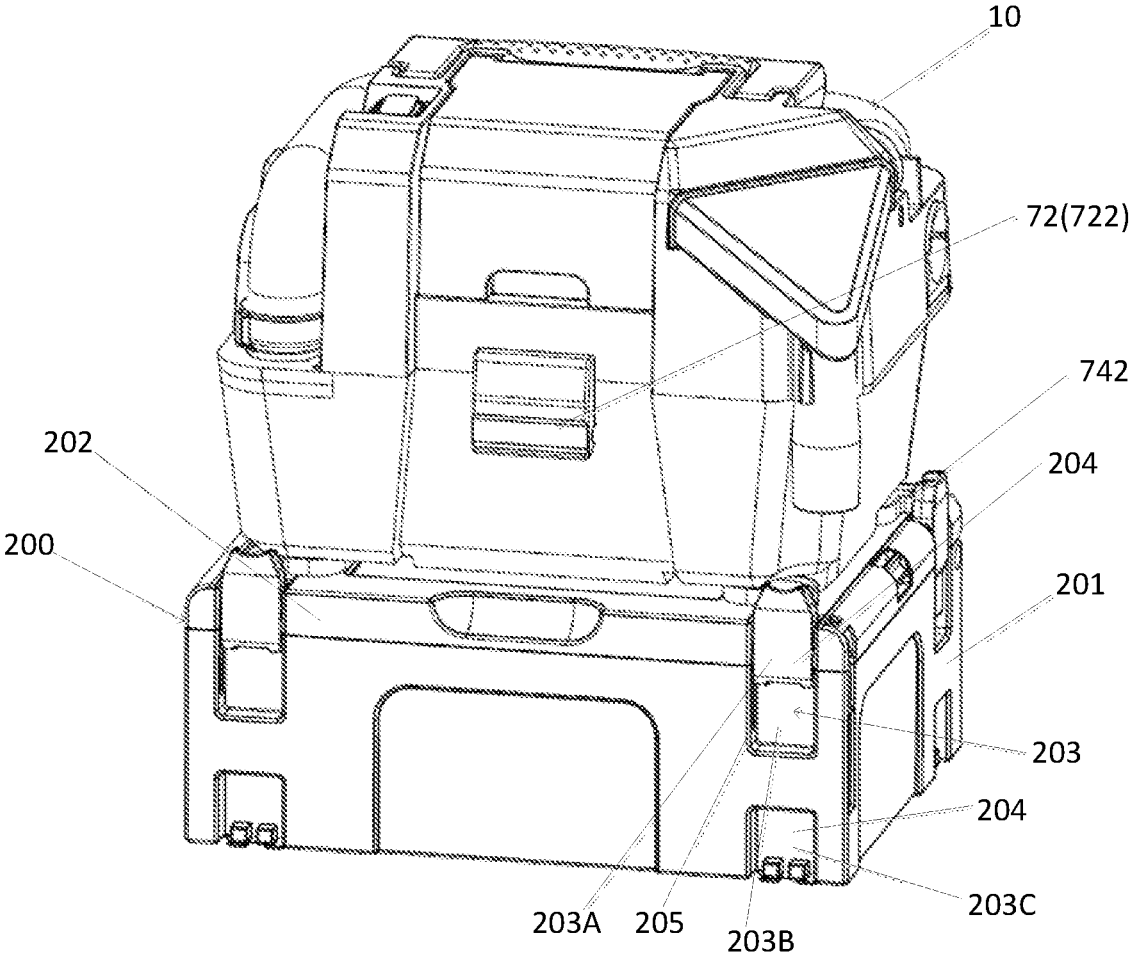
FIG. 14 is a perspective view of the vacuum cleaner of the present disclosure in a state where the vacuum cleaner is coupled to a tool box by means of the claw.

Embodiment of Claw:

Referring to FIGS. 12-14, engagement structures 74 for a tool box is provided at the four corners on the bottom surface of the tank body 71. The tool box 200 engagement structures 74 respectively include a claw housing part 741, a claw 742 and a threaded member 743.

The claw housing part 741 is formed by the bottom portion of the tank body 71 depressing inward from the outer periphery in a vicinity of the four corners. The recess has an L shape as viewed from the bottom, comprising a first housing part 741A and a second housing part 741B. The second housing part 741B is connected with the first housing part 741A and is perpendicular to the first housing part 741A in a plane parallel to the bottom surface of the tank body 71.

The claw 742 is a substantially L-shaped plate having a mounting hole 742A provided at one end of the plate and two claw portions 742B in the shape of protrusion at the other end of the plate. The shape of the claw portion 742B is not limited herein, as long as it facilitates engagement with the shape of a third locking portion of the tool box 200 as described below. Preferably, the claw portion 742B has a sectional shape that mates with the shape of the third locking portion of the tool box 200 as described below. The threaded member 743 passes through the mounting hole 742A of the claw 742 to be screwed upwards into a substantially central portion of the claw housing part 741 from downward the tank body 71.

The claw 742 is capable of rotating freely about the threaded member 743 in the plane of the claw housing part 741. When the claw 742 rotates toward the second housing part 741B, it abuts the wall portion of the second housing part 741B and stops at a receptacle position. When the claw 742 rotates toward the first housing part 741A, it abuts the wall portion of the first housing part 741A and stops at an engagement position. The engagement position is corresponding to the position of the third locking portion of the tool box 200 attaching the locking member 204. Referring to FIG. 13, the tank body 71 and the tool box 200 are secured together by means of the claw 742.

To facilitate understanding, the connection structure between the vacuum cleaner and the mating tool box 200 is described below with reference to FIGS. 14 and 20.

The tool box 200 has a substantially rectangular parallelepiped box-type construction, comprising a case body 201 opening upwards and a cover body 202 pivotably joined to the rear edge at the opening side of the case body 201. Locking structures 203 is respectively provided at upper and lower portions of the front surface and the left and right surfaces of the tool box 200.

To better explain the present disclosure, one locking structure 203 provided on the front surface is described; and the rest locking structures 203 have the same construction.

Figure 20:
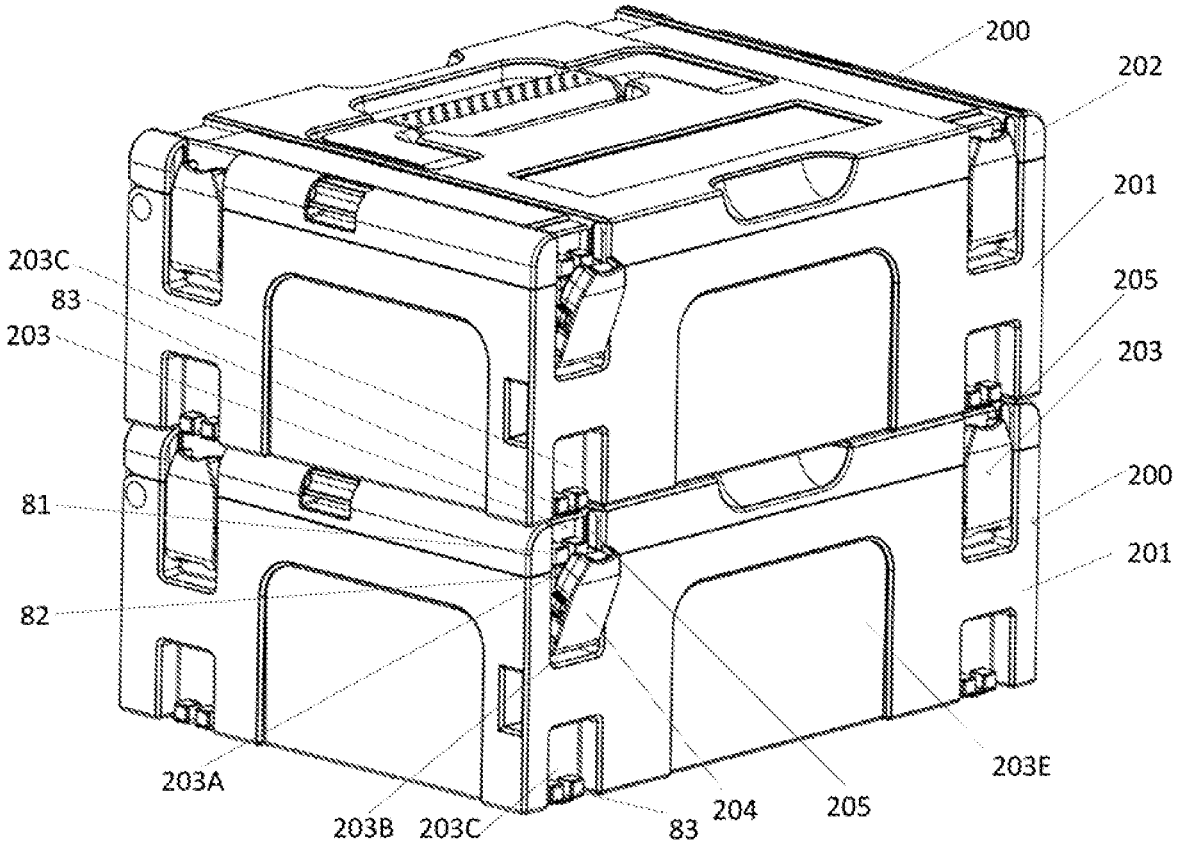
FIG. 20 is a perspective view of the connection structure of the tool box.

As shown in FIGS. 14 and 20, the locking structure 203 comprises a first recess 203A provided in the cover body 202, a second recess 203B provided in the case body 201 and a third recess 203C provided in the case body 201. The first recess 203A depresses from the front side of the cover body 202 toward the rear side of the cover body 202 and penetrates the cover body 202 in the vertical direction. The second recess 203B is formed by depressing from the front surface of the case body 201 toward the rear side in a range from the upper surface of the case body 201 to midway in the vertical direction of the case body 201. When the cover body 202 is closed, the second recess 203B is continuous with the first recess 203A. The third recess 203C is formed by depressing from the front surface of the case body 201 toward the rear side in a range from the lower surface of the case body 201 to midway in the up-and-down direction of the case body 201. The third recess 203C has its upper end spaced apart from the lower end of second recess 203B. The first recess 203A, the second recess 203B and the third recess 203C have the same width and are aligned to each other in the up-and-down direction.

There is provided first guiding grooves respectively in the range from midway to the lower end of the two side walls of the first recess 203A. An engagement recess is further formed by depressing in the first guiding grooves. On the two side walls of the second recess 203B, second guiding grooves are provided continuing to the first guiding grooves respectively. The first guiding groove and the second guiding groove together constitute a guiding groove 205 for the locking member 204. There is provided in the first recess 203A two first protrusions 81 disposed with an interval therebetween in the lateral direction of the front surface of the tool box 200, each of the first protrusions 81 having a square cross section. The first protrusion 81 has its lower edge aligned to the lower edge of the cover body 202. There is provided in the second recess 203B two second protrusions 82 disposed with an interval therebetween in the lateral direction of the front surface of the tool box 200, each of the second protrusions 82 having a square cross section. The second protrusion 82 has its upper edge aligned to the upper edge of the case body 201. There is provided in the third recess 203C two third protrusions 83 disposed with an interval therebetween in the lateral direction of the front surface of the tool box 200, each of the third protrusions 83 having a square cross section. The third protrusion 83 has its lower edge aligned to the lower edge of the case body 201.

The locking mechanism further comprises a locking member 204. The locking member 204 is a plastic plate having a width that can be retained in the first recess 203A, the second recess 203B and the third recess 203C. The locking member 204 has guided protrusions provided respectively at the lower ends on both side surfaces of the plate, the guided protrusions being symmetrically provided and capable of being engaged in the guiding grooves 205 and allowing the locking member 204 to slide along the guiding groove 205 in a vertical direction. The locking member 204 further have, at a position on two side surfaces of the plate above the guided protrusion, engagement protrusions symmetrically arranged to be mated with the engagement recess. In addition, the locking member 204 has on a surface facing the first recess 203A and the second recess 203B a first locking portion, a second locking portion and a third locking portion of which the cross section has a square recess shape. The first locking portion, the second locking portion and the third locking portion are respectively arranged in two in a lateral direction of the front surface of the tool box 200 with an interval therebetween. The first locking portion is formed to have a shape such that it can be engaged with the first protrusion 81, the second locking portion formed to have a shape such that it can be engaged with the second protrusion 82, and the third locking portion formed to have a shape such that it can be engaged with the third protrusion 83. As the first protrusion 81 and the second protrusion 82 are adjacent to each other in a state where the cover body 202 is closed, the first locking portion and the second locking portion are continuous with each other.

When the cover body 202 is locked to the case body 201, the locking member 204 is guided by the second guiding groove to slide upwards in a state where the upper end of the locking member 204 is separated from the second recess 203B and the guided protrusion at its lower end is engaged in the second guiding groove. In a state where the first locking portion is aligned to the first protrusion 81 and the second locking portion is aligned to the second protrusion 82, the upper end of the locking member 204 is locked toward the second recess 203B. At this time, the first locking portion and the first protrusion 81 are engaged with each other, the second locking portion and the second protrusion 82 engaged with each other, and the engagement protrusion of the locking member 204 is engaged with the engagement recess.

In addition, when one tool box 200 is stacked on another tool box 200, the third locking portion is engaged with the third protrusion 83 of the another tool box 200, thereby the two tool boxes 200 are stacked and secured together.

When the vacuum cleaner is placed above a tool box 200, the locking member 204 is guided by the second guiding groove to slide upwards in a state where the upper end of the locking member 204 is separated from the second recess 203B and the guided protrusion at its lower end is engaged in the second guiding groove. In a state where the first locking portion is aligned to the first protrusion 81, the second locking portion is aligned to the second protrusion 82, and the third locking portion is aligned to the claw portion 742B, the upper end of the locking member 204 is locked toward the claw portion 742B. At this time, the first locking portion and the first protrusion 81 are engaged with each other, the second locking portion and the second protrusion 82 engaged with each other, the third locking portion and the claw portion 742B are engaged to each other, and the engagement protrusion of the locking member 204 is engaged with the engagement recess. Thereby, the vacuum cleaner is stacked and fixed to the tool box 200.

Figure 15:
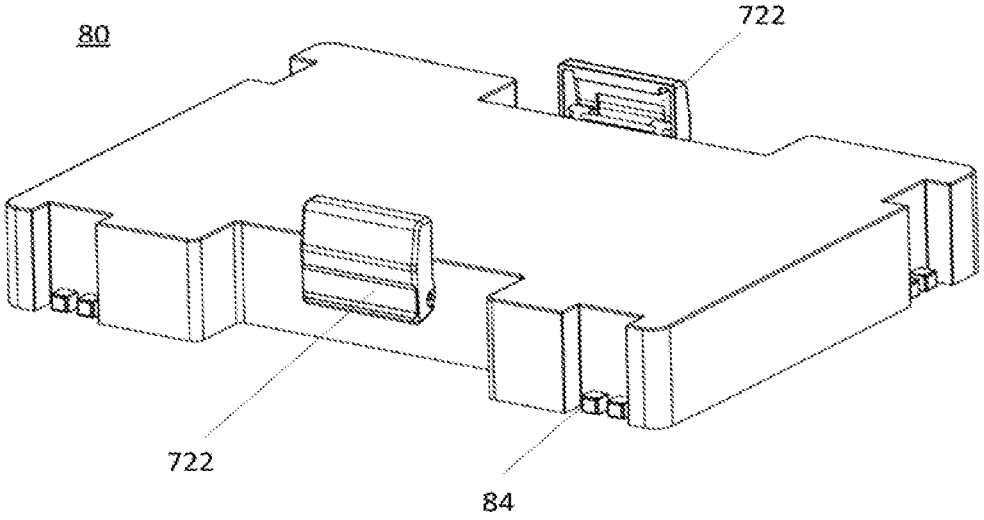
FIG. 15 is a perspective view of a connector of the present disclosure.
Figure 16:
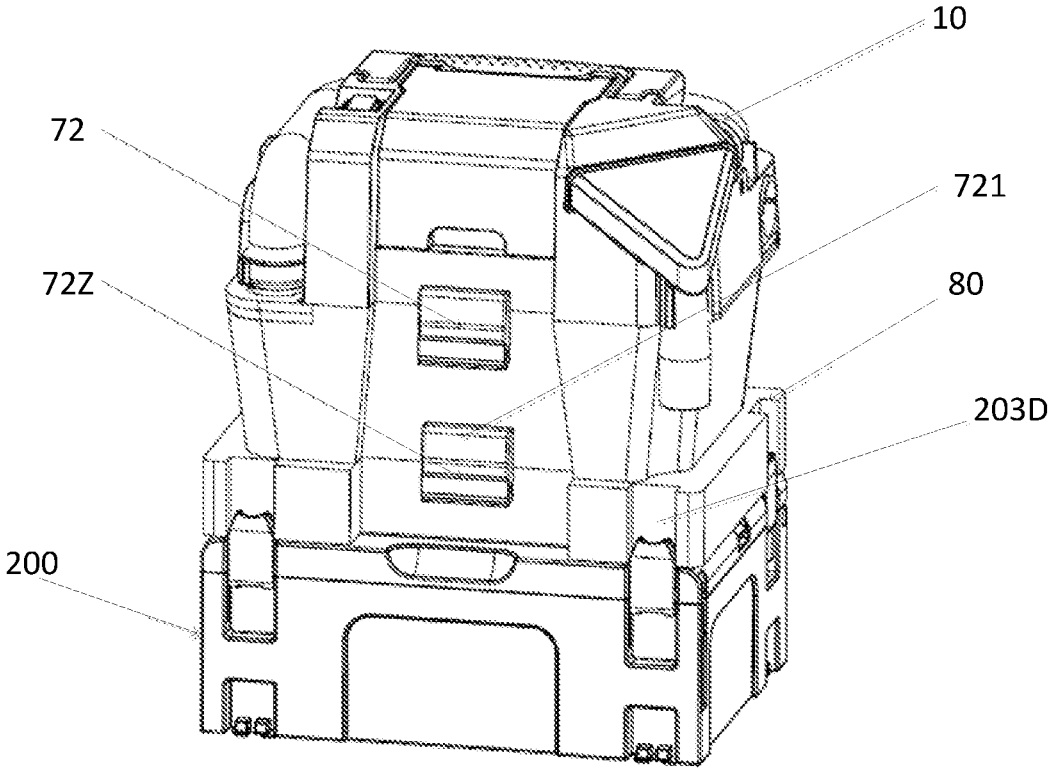
FIG. 16 is a perspective view of the vacuum cleaner of the present disclosure in a state where the vacuum cleaner is coupled to the tool box by means of the connector.

Embodiment of Connector:

The embodiment of a connector 80 is described with reference with FIGS. 15-16. Referring to FIGS. 15-16, the vacuum cleaner 10 further comprises a connector 80 and has another cam locking systems 72Z respectively at an lower side of the front and rear surfaces of the vacuum cleaner. The connector 80 has a substantially rectangular parallelepiped shape and has the same outer contour with the tool box 200 as viewed from above. On the front and rear surfaces of the connector 80, lock heads 722 for mating with the respective lock bodies 721 on the front and rear surfaces of the vacuum cleaner are provided. There is further provided on both sides of the front surface of the connector 80 a fourth recess 203D that depresses toward the rear side from the front surface of the connector 80 and penetrates from an upper end surface to a lower end surface of the connector 80. There is provided at a position close to the lower end of fourth recess 203D fourth protrusions 84 that are spaced apart in a lateral direction of the front surface of the connector 80 and have a square cross section.

When the vacuum cleaner is stacked and secured to a tool box 200, the connector 80 is placed above the tool box 200 such that the locking member 204 is guided by the second guiding groove to slide upward in a state where the upper end of the locking member 204 is separated from the second recess 203B and the guided protrusion at the lower end of the locking member 204 is engaged in the second guiding groove. In a state where the first locking portion is aligned to the first protrusion 81, the second locking portion is aligned to the second protrusion 82, and the third locking portion is aligned to the fourth protrusions 84, the upper end of the locking member 204 is locked to the fourth protrusion 84. At this time, the first locking portion is engaged with the first protrusion 81, the second locking portion is engaged with the second protrusion 82, the third locking portion is engaged with the fourth protrusions 84, and the engagement protrusion of the locking member 204 is engaged in the engagement recess. Next, the vacuum cleaner is placed above the connector 80, and the lock head 722 on the connector 80 is locked to the another lock body 721 on the front surface of the vacuum cleaner, and the connector 80 is coupled to the vacuum cleaner by means of the another cam locking systems 72Z. Thereby, the vacuum cleaner is stacked and secured to the tool box 200. Herein, an example is described with two cam locking systems 72Z. However, it is understood that there may be more than two cam locking systems 72Z.

By providing the vacuum cleaner with the above tool box installation accessories, the vacuum cleaner is allowed to be mated with the locking structure 203 of an available tool box 200. Thus, when it is desired to take the tool box 200 as well as the vacuum cleaner, the operator does not have to bring them separately and can carry the vacuum cleaner and the tool as a whole, which is more convenient.

The effect of the present disclosure is described below.

In the present disclosure, the intake port 211 is disposed in the tank body 71 and opens to the upwards; the exhaust port 218 is disposed in the case 21 of the drive head assembly 20 and opens to a lateral side. The exhaust port 218 is completely different from the intake port 211 in position and orientation. Therefore, the operator is able to clearly distinguish the exhaust port 218 and the intake port 211 from each other according to the appearance, and will not wrongly attach the suction hose 50 to an undesired part. Herein, of course, the above effect can also be achieved merely by providing the intake port 211 in the tank body 71 and the exhaust port 218 in the case 21 of the drive head assembly 20. By distinguishing the orientations of the intake port 211 and exhaust port 218, the two ports can be further easily distinguished from each other. In addition, in the vacuum cleaner, external dust and liquid is sucked into the tank body 71 via the suction hose 50. Therefore, the operator can identify from the appearance that the port provided in the tank body 71 is the intake port, reducing the difficulty of identifying the ports for a first-time user.

Furthermore, the vacuum cleaner can be used by a left-handed person or a right-handed person without difficulty. Since the exhaust port 218 and the intake port 211 are provided far away from each other, even if the air discharged from the exhaust port 218 blows the dust, it would not greatly affect the dust vacuuming at the intake port 211. Moreover, as the exhaust port 218 is located at a rear side of the operator in use of the vacuum cleaner, even the dust is blown to scatter around, it would not bring a great influence to the operator.

In the present disclosure, the first suction head accessory retaining part 214A is provided at a lower side of the grip retaining part 216 and is continuous with the grip retaining part 216; and the intake port 211, the hose retaining part 212, the second suction head accessory retaining part 214B and the third suction head accessory retaining part 214C are each configured to be a part formed by the case 21 depressing inwardly from the outer surface. As a result, unnecessary space taken by the cavity in the case 21 is reduced, thereby compactly receiving the suction head accessory and the grip 215. Moreover, the space of the case 21 at an inner side than the rectangular parallelepiped outer contour is made full use of, thereby realizing miniaturization and weight lightening of the vacuum cleaner.

Further, in the present disclosure, the motor 22 uses a brushless motor, thereby miniaturizing the motor and improving the service period of the motor, which improves the design freedom for a compact arrangement of the suction hose 50, the suction head accessory 60, etc., so as to realize miniaturization and weight lightening of the vacuum cleaner and enhancing the efficiency of the vacuum cleaner.

In the present disclosure, by providing the battery cover 221 above the battery housing space 217, it is possible to prevent the battery 30 from becoming dirty or being wetted by a simple structure. Moreover, the battery 30 can be easily replaced by opening the battery cover 221.

By providing the drainage groove 217D at a part on the upper surface of the wall portion of the battery housing space 217 mating with the battery cover 221, in a state where the battery cover 221 is closed, when liquid wets the case 21 or the battery cover 221, the liquid will be lead to the drainage groove 217D and be guided by the drainage groove 217D to be discharged from the front surface of the vacuum cleaner. Thereby, liquid is prevented from entering the interior of the battery housing space 217 and damaging the circuit.

In addition, the battery housing space 217 is located at a central portion of the case 21; and the battery 30 is inserted into the battery housing space 217 by sliding in a horizontal direction, thereby reducing the height taken by the battery 30, which realizes compact miniaturization, as well as acquiring balance in weight of the whole vacuum cleaner.

Further, by providing the inclined surface 217C and the mirror member on the wall portion of the battery housing space 217, the display value of the battery level display 31 is reflected from the mirror member. Thus, the operator is able to easily read the display value of the battery level display 31 from the mirror member. Therefore, even if the battery 30 for power tools is arranged to the vacuum cleaner of the present disclosure, there is no difficulty for the operator to read the remaining electricity quantity displayed by the battery level display 31.

Furthermore, by using the cylindrical floating cup 47 opening downward, when the liquid level reaches a position where the distance to the lower surface of the drive head assembly 20 is equal to the total thickness of the sponge and the closed bottom portion of floating cup 47, the floating cup 47 starts to block air flow between the filter system and the fan 23. As compared with a floating ball having a larger dimension in the up-and-down direction, the floating cup 47 increases the effective volume of the liquid contained by the tank body 71. Further, since the floating cup 47 has a larger stressed area, the buoyant force applied to the floating cup 47 is larger. Thus, the floating cup 47 is more sensitive to the rise of the liquid level. Moreover, since the sponge 49 is provided at the bottom portion of the floating cup 47, when the floating cup 47 abuts the drive head assembly 20 under a buoyant force, the impact force between the floating cup 47 and the drive head assembly 20 is reduced, as well as a sealing function realized.

Moreover, by providing at the periphery on the opening side of the tank body 71 the outer flange 711 partly protruding outwards and the inner flange 712 partly protruding inwards, the outer flange 711 functions to easily pour the liquid or duct collected in the tank body 71 without any remain, and the inner flange 712 further improves the seal performance. Thereby, the pouring performance is ensured as well as the seal performance. The outer flange 711 also reinforces the strength of the tank body 71.

Furthermore, in the present disclosure, by providing the vacuum cleaner with the tool box installation accessory, the vacuum cleaner is allowed to mate with the locking structure 203 of an available tool box 200. Thus, when it is desired to carry the tool box 200 as well as the vacuum cleaner, the operator does not need to bring them separately and is able to carry the vacuum cleaner and the tool as a whole, which is more convenient.

Specific examples of the present disclosure are described above. However, they are no more than examples and do not limit the claims. The technology described in the claims includes the technical solutions with various changes and modifications made to the above specific examples.

For example, examples of modifications are provided below.

Modification 1:

Modification 1 of the present disclosure is described with reference to FIGS. 17-19. In the above embodiment, the intake port 211 is provided to directly face the interior of the tank body 71 and is open to the upwards, and the exhaust port 218 is provided in the case 21 and faces the interior of the case 21. Different from the embodiment, in Modification 1, the intake port 211' opens to the bottom of the tank body 71'.

Figure 17:
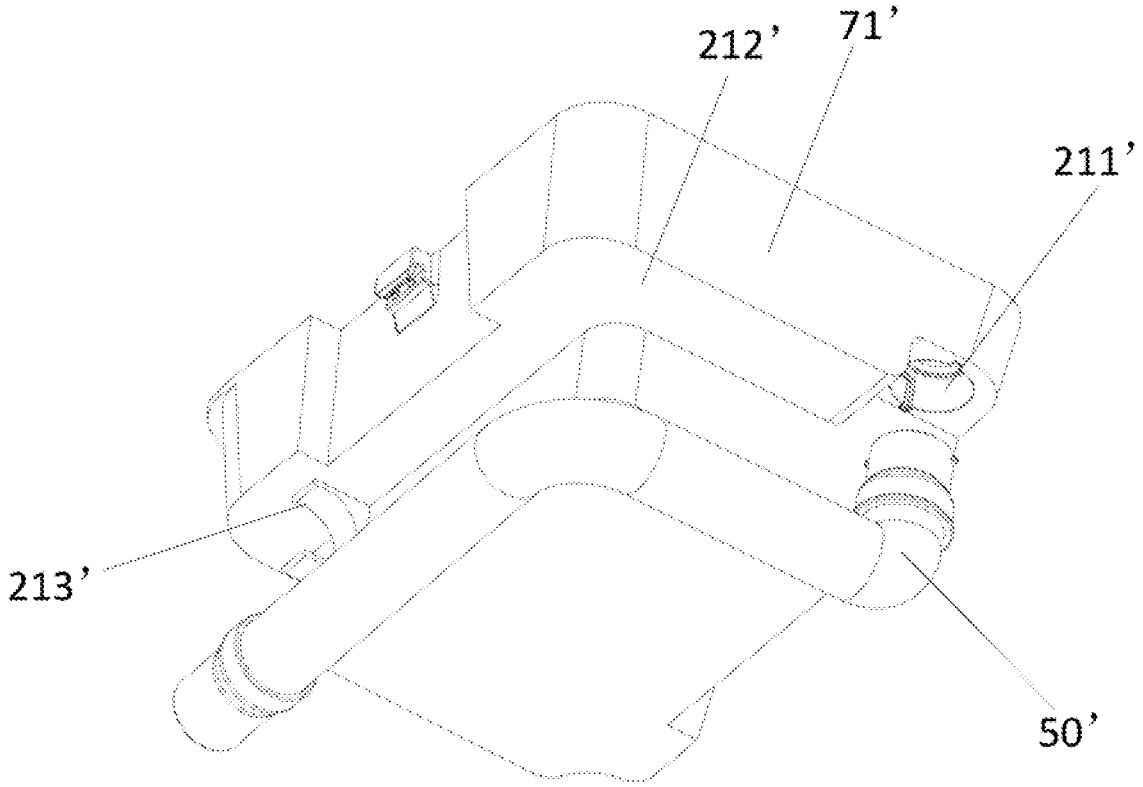
FIG. 17 is a perspective view of Modification 1 where a suction hose is received in the tank body.
Figure 18:
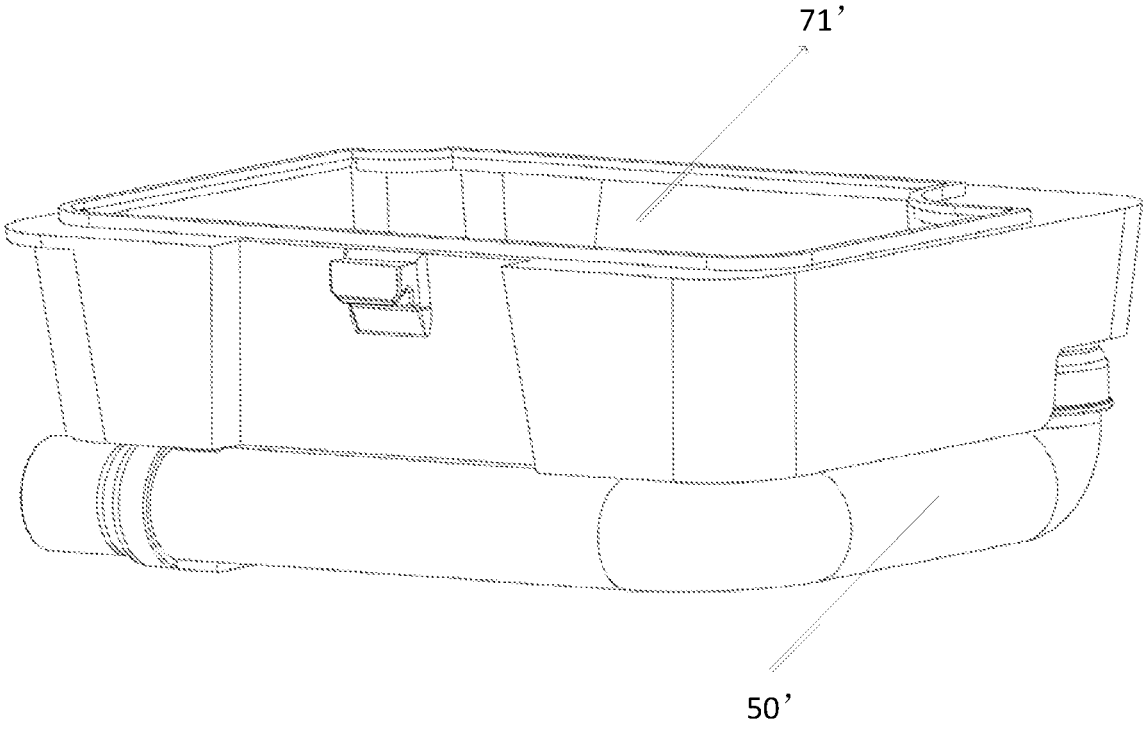
FIG. 18 is a further perspective view of Modification 1 where the suction hose is received in the tank body.
Figure 19:
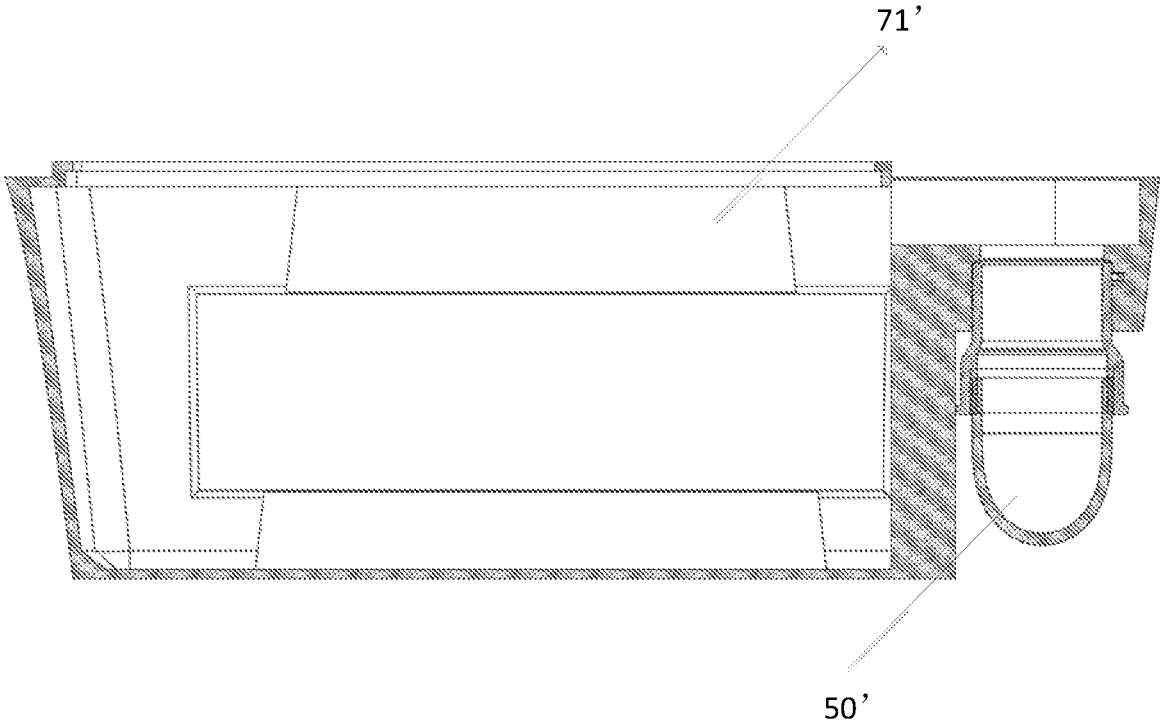
FIG. 19 is a sectional view of Modification 1 where the suction hose is received in the tank body.

The tank body 71' has a rectangular parallelepiped shape that is open to the upwards and has a lost corner portion formed by one corner portion depressing inwards from the outer side (as shown in FIGS. 17-18, the right rear corner portion in this embodiment). The intake port 211' is provided at the bottom portion of the lost corner portion. A base end portion of the suction hose 50' is secured to the intake port 211'. An inlet mark is indicated in the vicinity of the intake port 211'. As for the method for securing the base end portion of the suction hose 50' to the intake port 211', as shown in FIG. 19, it is realized by inserting one end of the suction hose 50' into the tank body 71', and then rotating the end of the suction hose 50' with regard to the intake port 211' to fasten and secure the end of the suction hose 50' to the intake port 211'. Of course, the method for securing the end of the suction hose 50' to the intake port 211' is not limited hereby. One skilled in the art may choose other available method if need. Hence, the intake port 211' directly faces to the tank body 70', and the air taken in by the suction hose 50' directly enters the tank body 70'.

One side portion on the lower surface of the tank body 71' adjacent to the intake port 211' and another side portion adjacent to the one side portion depress toward an upper side to form a hose retaining part 212' for retaining the suction hose 50'. In a retaining state of the suction hose 50', the suction hose 50' extends, along the hose retaining part 212', around the outer circumferential surface of the tank body 71' from the intake port 211' to the vicinity of a corner portion of the tank body 71' opposing to the corner portion of the intake port 211' in a diagonal direction. At an end of the hose retaining part 212', there is provided a fixing sheet 213' for fixing the distal end portion of the suction hose 50'. The fixing sheet 213' is configured to have a C-shaped cutout opening to the front side. By fitting the distal end portion of the suction hose 50' into the C-shaped cutout and blocking a large-radius portion at the distal end portion of the suction hose 50' with the fixing sheet 213', as shown in FIGS. 17-18, the distal end portion of the suction hose 50' is reliably fixed to the fixing sheet 213'. In addition, as mentioned in the previous embodiment, although not shown, the hose holding members erecting from the outer periphery surface of the tank body 71' can be provided at intervals at an outer periphery of the hose retaining part 212', the hose holding members holding and fixing the suction hose 50' retained in the hose retaining part 212'.

By providing the hose retaining part 212' in such a manner, the space at an inner side than the outer contour of the rectangular parallelepiped shape of the tank body 71' can be made full used of. Thus, miniaturization and weight lightening of the vacuum cleaner is realized.

Modification 2:

The foresaid embodiment and modification are described by an example where the intake port is provided in the tank body assembly and the exhaust port provided in the drive head assembly. However, the present disclosure is not limited hereby. The intake port may be provided in the drive head assembly and the exhaust port may be provided in the tank body assembly. Such, the effect achieved by the foresaid embodiment and modification can also be obtained. Moreover, even when there is retained a suction hose 50, the drive head assembly 20 can be easily separated from the tank body.

Modification 3:

In the foresaid embodiment and modifications, the lower part of the tank body is directly connected to the tool box or connected to the tool box by means of a connector. However, the present disclosure is not limited hereby. The connection may be realized by a structure where drive head assembly (the case) has a part extending downward so that the part of the drive head assembly (case) is able to be connected to the tool box or is connected to the tool box by means of a connector.

Modification 4:

In the foresaid embodiment and modifications, a part of the upper end edge of the tank body is bending inward and another part bending outward. However, the present disclosure is not limited hereby. The structure may be formed by a part of the upper end portion of the tank body has a bent shape or a curved shape, and the rest part of the upper end portion of the tank body has a shape neither bending inward nor curved inward. Further, in this description, "bent" means to bend at an angle; and "curved" means to bend at a curvature. Hence, it can be prevented that the part having the shape bent or curved inward blocks dust causing the dust cannot be thoroughly poured out. Meanwhile, the seal performance is guaranteed. In addition, when at least a part of the upper end portion of the tank body has the bent shape, the upper surface of the upper end portion of the tank body has a shape of a planar portion with a length thereof in the thickness direction of the wall portion of the tank body longer than the thickness of the wall portion of the tank body, which reliably improves the seal performance.

Furthermore, in the foresaid embodiment and modifications, a duct collecting bag for collecting dust collected into an interior of the tank body is not arranged at the upper end portion of the tank body. The technical solution that the duct collecting bag is provided at the upper end of the tank body of the vacuum cleaner includes both the situation where the dust collecting bag is directly secured to the upper end of the tank body of the vacuum cleaner and the situation where the dust collecting bag is indirectly secured to the upper end of the tank body of the vacuum cleaner.

In addition, where there are various suction head accessories of different shapes, the shape of a hose end assembly retaining part can be changed accordingly for adaptively retaining suction head accessories of various shape.

Moreover, the shape and the number of the claw portion 742B can be changed flexibly, as long as the claw portion 742B is capable of being engaged with the locking member 204 of the tool box 200. Different connection method can be chosen for the connection between the connector and the tool box and the connection between the connector and the vacuum cleaner according to the actual situation.

INDUSTRIAL APPLICABILITY

The vacuum cleaner of the present disclosure is applicable for a portable vacuum cleaner that can be arranged with a battery 30 for power tools.

What is claimed is:

1. A portable vacuum cleaner comprising:

a tank body;

a head portion disposed above the tank body, a battery connection portion being located at the head portion;

a hose for collecting dust;

a bottom surface on which the vacuum cleaner is configured to rest; and a hose retaining portion (i) formed by depressing an outer circumferential face of the portable vacuum cleaner inward and (ii) formed so as to wrap around a corner of the outer circumferential face so that a portion of the hose retained by the hose retaining portion bends around the corner of the outer circumferential face, wherein the hose retaining portion is further configured such that the portion of the hose retained by the hose retaining portion extends in a direction substantially parallel with the bottom surface.

2. The vacuum cleaner according to claim 1, wherein the tank body includes the hose retaining portion, and the outer circumferential face in which the hose retaining portion is formed is an outer circumferential face of the tank body.

3. The vacuum cleaner according to claim 1, wherein the head portion includes the hose retaining portion, and the outer circumferential face in which the hose retaining portion is formed is an outer circumferential face of a case of the head portion.

4. The vacuum cleaner according to claim 1, wherein the hose retaining portion is formed so that the retained portion of the hose, which is in contact with a surface of the hose retaining portion, extends in a first direction and then in a second direction perpendicular to the first direction.

5. The vacuum cleaner according to claim 1, wherein the hose retaining portion comprises, between first and second ends of the hose retaining portion, a first surface connected at an end of the first surface to a second surface extending in a second direction different than a first direction in which the first surface extends.

6. The vacuum cleaner according to claim 5, wherein the first direction is perpendicular to the second direction.

* * * * *